US007841551B2

(12) United States Patent
Potter et al.

(10) Patent No.: US 7,841,551 B2
(45) **Date of Patent: *Nov. 30, 2010**

(54) DROP-IN ANVILS FOR AN IMPACT CRUSHING APPARATUS

(75) Inventors: Jason Potter, Rising Sun, IN (US); Jason Knueven, Sunman, IN (US); Chris Nawalaniec, Cincinnati, OH (US); Doug Weber, Aurora, IN (US)

(73) Assignee: Eagle Crusher Company, Inc, Galion, OH (US)

( * ) Notice: Subject to any disclaimer, the term of this patent is extended or adjusted under 35 U.S.C. 154(b) by 458 days.

This patent is subject to a terminal disclaimer.

(21) Appl. No.: 12/026,957

(22) Filed: Feb. 6, 2008

(65) Prior Publication Data

US 2009/0194620 A1 Aug. 6, 2009

(51) Int. Cl.
*B02C 1/10* (2006.01)
*B02C 1/12* (2006.01)
*B02C 23/02* (2006.01)

(52) U.S. Cl. ..... 241/275

(58) Field of Classification Search ..... 241/5, 241/275

See application file for complete search history.

(56) References Cited

U.S. PATENT DOCUMENTS

| | | | | |
|---|---|---|---|---|
| 271,138 | A | 1/1883 | Sharpneck | |
| 982,516 | A | 1/1911 | Marks | |
| 994,596 | A | 6/1911 | Marks | |
| 1,267,110 | A | 5/1918 | Parsons et al. | |
| 1,532,742 | A | 4/1925 | Hadsel | |
| 1,547,385 | A | 7/1925 | Hadsel | |
| 3,135,326 | A | 6/1964 | Santee | |
| 3,606,182 | A * | 9/1971 | Warren | 241/275 |
| 3,768,209 | A | 10/1973 | Punter et al. | |
| 3,834,631 | A * | 9/1974 | King | 241/26 |
| 4,166,585 | A * | 9/1979 | Alford et al. | 241/275 |
| 4,389,022 | A | 6/1983 | Burk | |
| 6,783,092 | B1 | 8/2004 | Robson | |
| 7,284,721 | B2 * | 10/2007 | Strauss et al. | 241/275 |

(Continued)

OTHER PUBLICATIONS

Black Clawson, Inc., "The Inside Story . . . ," The Black Clawson Centri Crusher—The Leader in Centrifugal Impact Crusher Technology Brochure (Available at least prior to Feb. 6, 2008).

(Continued)

*Primary Examiner*—Bena Miller
(74) *Attorney, Agent, or Firm*—Taft Stettinius & Hollister LLP; Stephen F. Rost

(57) ABSTRACT

The present invention provides an impact crushing apparatus that includes a housing, a chamber defined within the housing, a rotor assembly for receiving material and throwing the material radially outward, a lid for closing the chamber, and a plurality of anvils positioned around the rotor assembly and configured to break apart the material. The lid includes a plurality of openings positioned about its perimeter and the plurality of anvils are slidably receivable in the plurality of openings, wherein the anvils include a top portion and a bottom portion having an impact surface configured to break apart the material, the top portion being supported by the top surface of the lid and the bottom portion positioned within the chamber such that the material collides with the impact surface of the plurality of anvils and breaks apart.

23 Claims, 38 Drawing Sheets

U.S. PATENT DOCUMENTS

| | | | | |
|---|---|---|---|---|
| 2005/0001082 | A1* | 1/2005 | Strauss et al. | 241/275 |
| 2007/0108327 | A1* | 5/2007 | Rodriguez | 241/275 |
| 2008/0121741 | A1* | 5/2008 | Huang | 241/5 |
| 2008/0191077 | A1* | 8/2008 | Bentley | 241/275 |

OTHER PUBLICATIONS

Carri-Cell Rock Breaker Inc., "The Carri-Cell Impact Breaker", Bulletin No. CC-001-1M-83 (Available at least prior to Feb. 6, 2008).

* cited by examiner

DROP-IN ANVILS FOR AN IMPACT CRUSHING APPARATUS

BACKGROUND

The present invention generally relates to the field of impact crushers and, more particularly, to a vertical shaft impactor apparatus with improved designs for reducing its size and enhancing the accessibility and replaceability of components for maintaining the apparatus.

Impact crushing apparatuses are known and employed in various industries for reducing materials such as rock, concrete, brick, stone, and other earthly materials into smaller shapes and sizes for further use or disposal of. In a typical impact crushing apparatus, materials are fed into a chamber and onto a rotating feed disk. The material is thrown from the center of the rotating feed disk at high speeds against an impact surface, where due to the centrifugal forces, the material is broken into smaller pieces.

Impact crushing apparatuses are generally very large and consume significant floor space. In addition, an exemplary crushing apparatus includes a drive unit such as an electric motor required to rotate the feed disk. The electric motor usually has to be positioned near the feed disk and attached to the housing that encloses the chamber to tension drive belts and other drive components. This further increases the size of the space needed for the crushing apparatus. The drive unit is connected to and drives a shaft, which in turn is connected to the feed disk.

These apparatuses also present maintenance difficulties due to their size and configuration. For example, replacing a worn anvil may require a person to remove the lid of the housing and reach over the top of the chamber to gain access to the anvil ring that holds the anvils. The anvil ring must then be removed before the worn anvil can be removed and replaced. In other words, replacing the anvil requires the apparatus to be opened and this presents additional disadvantages, such as subjecting the person to injury from sharp debris inside the chamber and delaying the crushing operation for maintenance.

The components of these impact crushing apparatuses that engage with the flow of material are subject to wear, which may be caused by abrasion, grinding, decomposition, impact, and the like. At least one surface of the anvil makes contact with the material and requires replacement or maintenance depending on the amount of use. This can be expensive and increase the amount of downtime associated with the crushing operation.

Based on at least these reasons, there is a need to improve the design and configuration of the impact crushing apparatus. More specifically, there is a need for an impact crushing apparatus that is small and easier to access and maintain.

SUMMARY OF THE INVENTION

An embodiment of the present invention provides an impact crushing apparatus that includes a housing, a chamber defined by the housing and having a central region and an outer periphery, and a rotor assembly disposed within the central region of the chamber and configured to receive and transport material from the central region to the outer periphery of the chamber. In this embodiment, a lid is provided for closing the chamber and the lid has a plurality of openings positioned about the perimeter of the lid. A plurality of anvils are disposed about the outer periphery of the chamber and circumscribe the rotor assembly. The anvils are slideably receivable in the plurality of openings in the lid, wherein the anvils include a top portion and a bottom portion having an impact surface configured to break apart the material. The top portion is secured to the top surface of the lid and the bottom portion is positioned within the chamber having its impact surface face the rotor assembly when the lid is closed.

The present invention is explained in more detail hereinafter on the basis of advantageous embodiments shown in the figures. The special features shown therein may be used individually or in combination to provide embodiments of the present invention.

BRIEF DESCRIPTION OF THE DRAWINGS

The above-mentioned aspects of the present invention and the manner of obtaining them will become more apparent and the invention itself will be better understood by reference to the following description of the embodiments of the invention, taken in conjunction with the accompanying drawings, wherein:

FIG. 20 is a perspective view of an impact crushing apparatus with a rock shelf;

Corresponding reference numerals are used to indicate corresponding parts throughout the several views.

DETAILED DESCRIPTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

Figure 1:
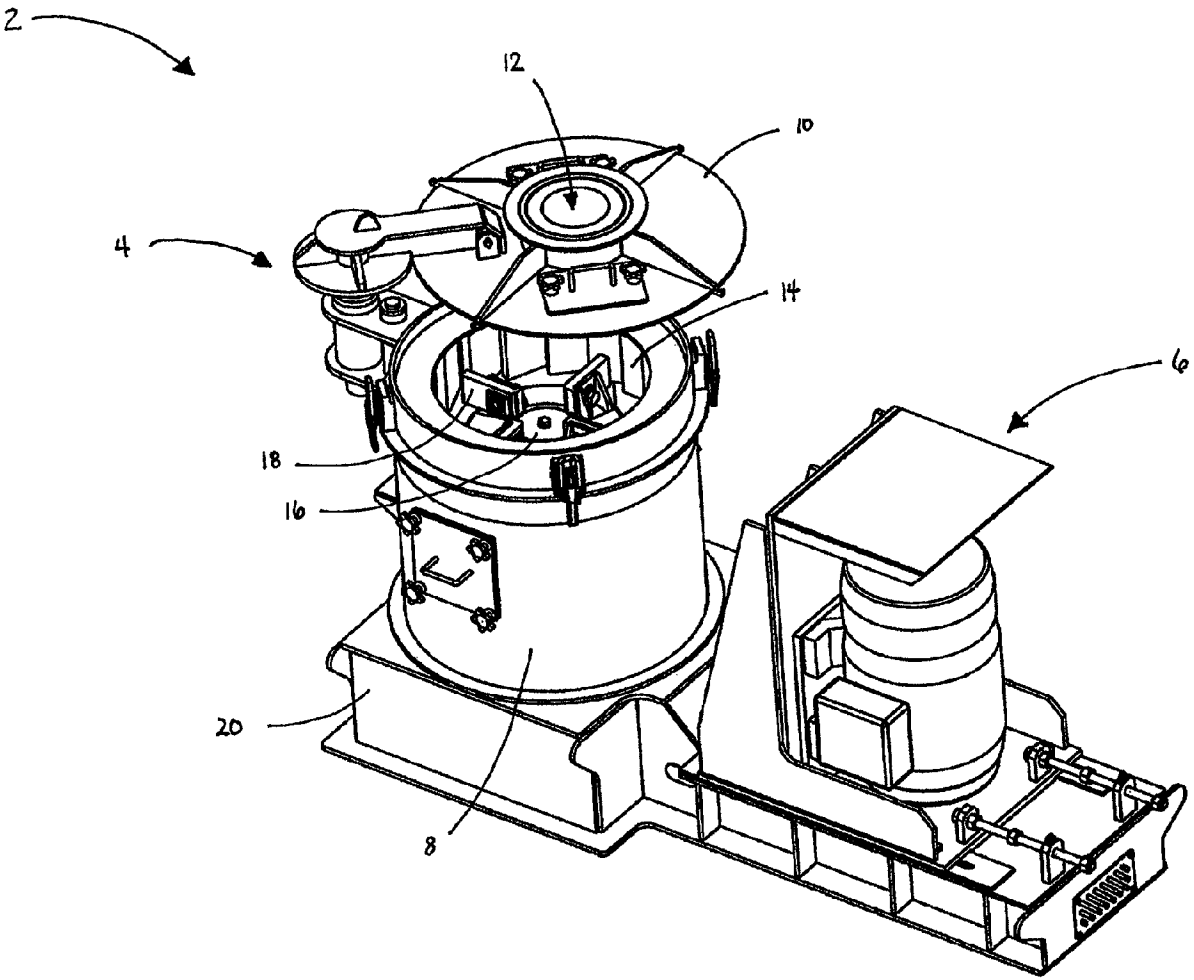
Fig. 1 (Prior Art)
FIG. 1 is a perspective view of a vertical shaft impact system known in the prior art in which a lid is shown in an open position.
Figure 2:
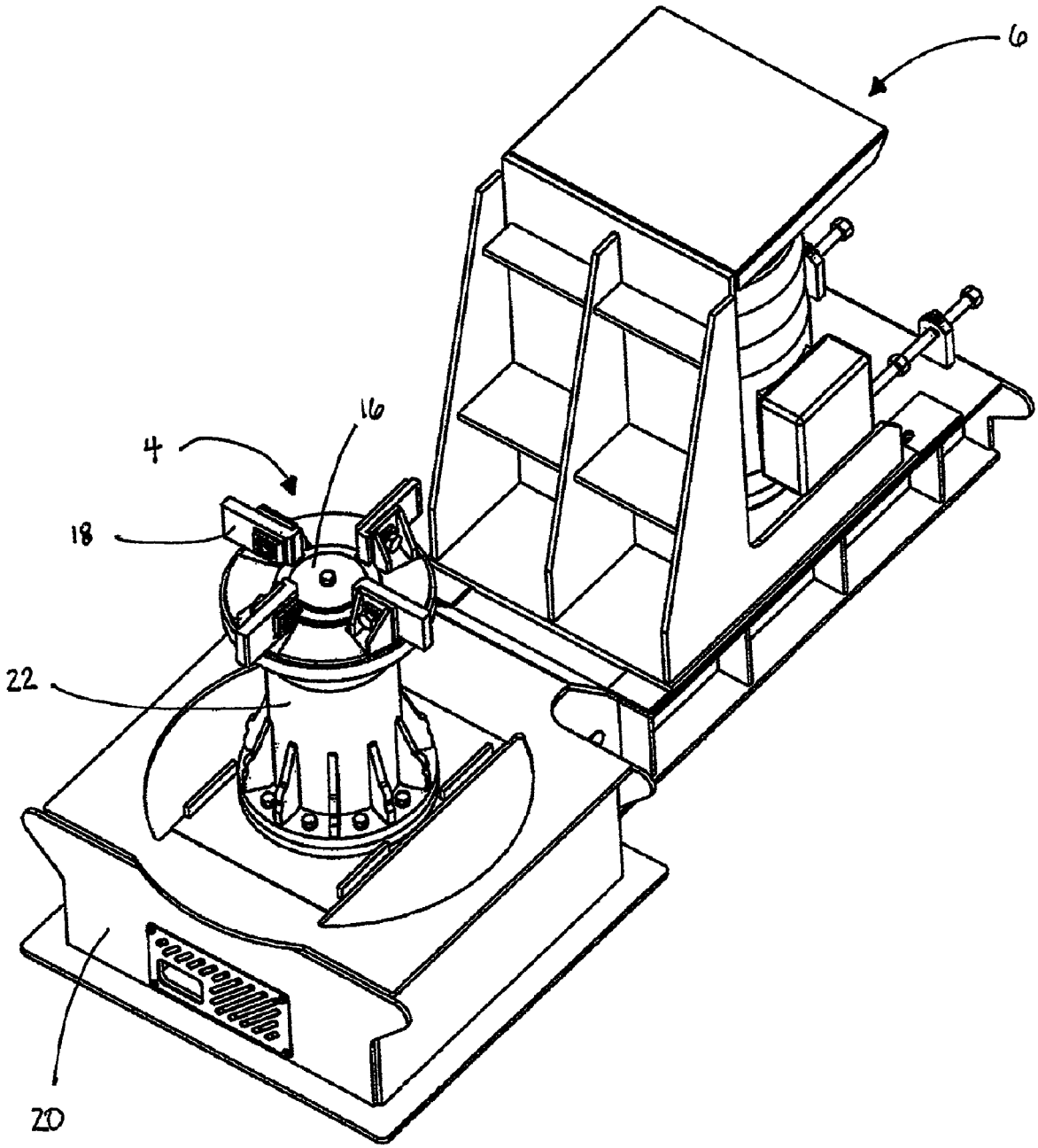
Fig. 2 (Prior Art)
FIG. 2 is a perspective view of the vertical shaft impact system of FIG. 1 in which a housing and the lid are removed to show the internal components.
Figure 3:
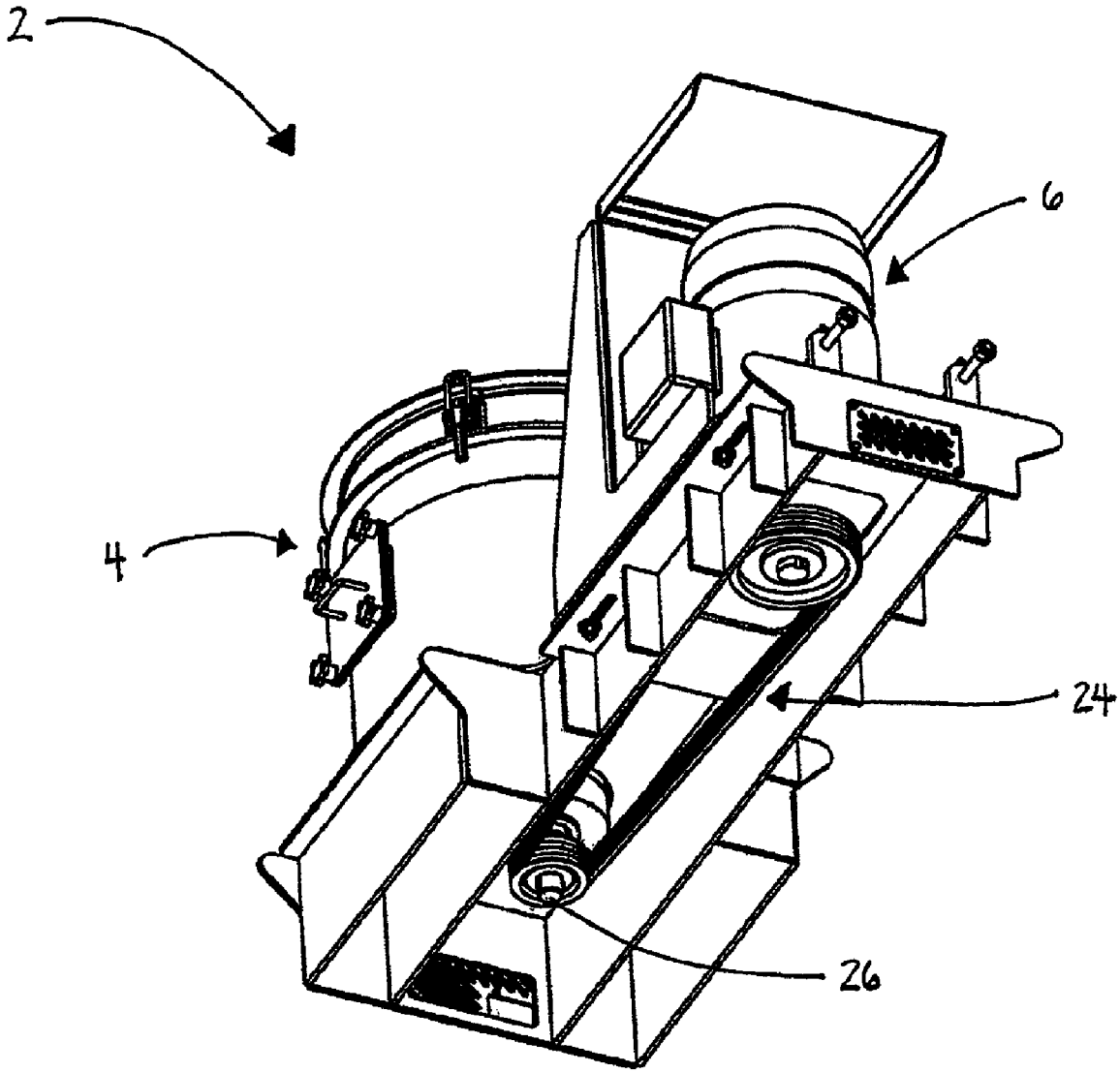
Fig. 3 (Prior Art)
FIG. 3 is a perspective view from below the vertical shaft impact system of FIG. 1 in which a V-belt assembly is shown between a vertical shaft impact assembly and an electric drive unit.

A vertical shaft impact ("VSI") system known in the art is shown in FIGS. 1-3. The VSI system 2 includes a VSI assembly 4 and an electric motor assembly 6. The VSI assembly 4 has an exterior housing 8 and a lid 10 that lifts from a closed position to an open position. This lid 10 includes a central opening 12 that is connected to a hopper (not shown), which is filled with material to be crushed. The housing 8 sits on a base 20 and encloses a rotor assembly 16 and a plurality of anvils 14. The rotor assembly 16 includes impeller shoes 18.

The housing 8 encloses a shaft 26 as illustrated in FIG. 3. The shaft 26 is connected to a V-belt drive assembly 24 and to the rotor assembly 16. The electric motor assembly 6 drives the V-belt drive assembly 24, which in turn rotates the shaft 26. As the shaft 26 rotates, the rotor assembly 16 and, in particular, the impeller shoes 18 rotate. Material (not shown) that is released from the hopper (not shown) passes through the central opening 12 and into the rotor assembly 16 where it is projected radially outward by the impeller shoes 18. The material contacts the anvils 14 at high speed, and due to the centrifugal forces applied to the material, the material breaks apart into smaller shapes and sizes.

In the prior art VSI system 2 of FIGS. 1-3, the V-belt drive system 24 operates effectively and efficiently only when the tension in the belts remain taut. Thus, the VSI assembly 4 must be positioned in close proximity to the electric drive assembly 6 to meet this requirement. Unfortunately, this creates an expansive setup that requires significant floor space. Also, as shown in FIG. 2, the VSI assembly 4 further includes a bearing cartridge 22 that surrounds the shaft 26. In this design, the housing 8 encloses both the bearing cartridge 22 and the shaft 26, which are both within a crushing chamber and subject to being damaged by flying debris. Therefore, a need has arisen for creating a more compact VSI design, while also limiting the potential damage that could be caused by debris.

Figure 4A:
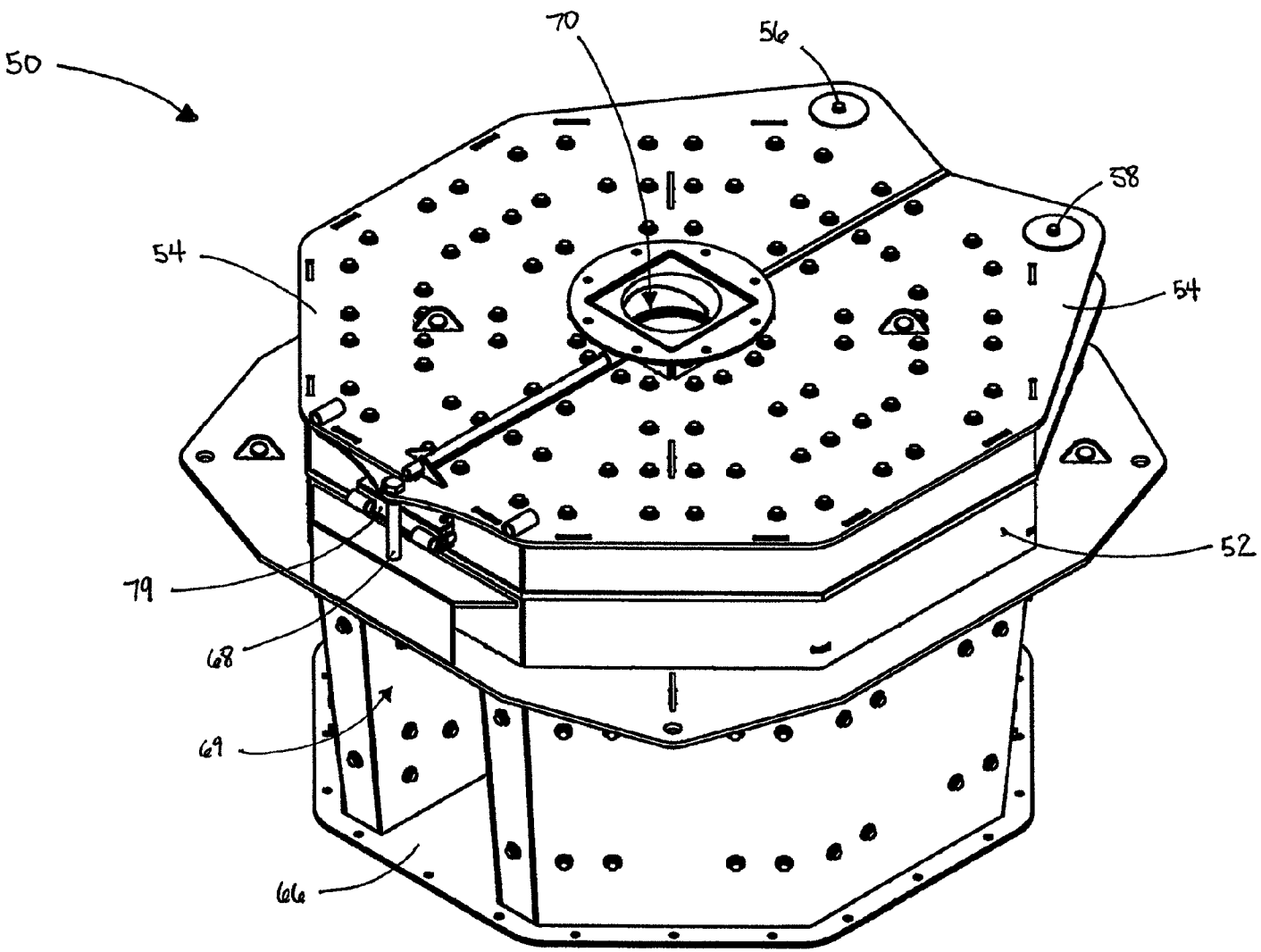
FIG. 4A is a perspective view of an impact crusher in a closed position according to an embodiment of the present invention.
Figure 4B:
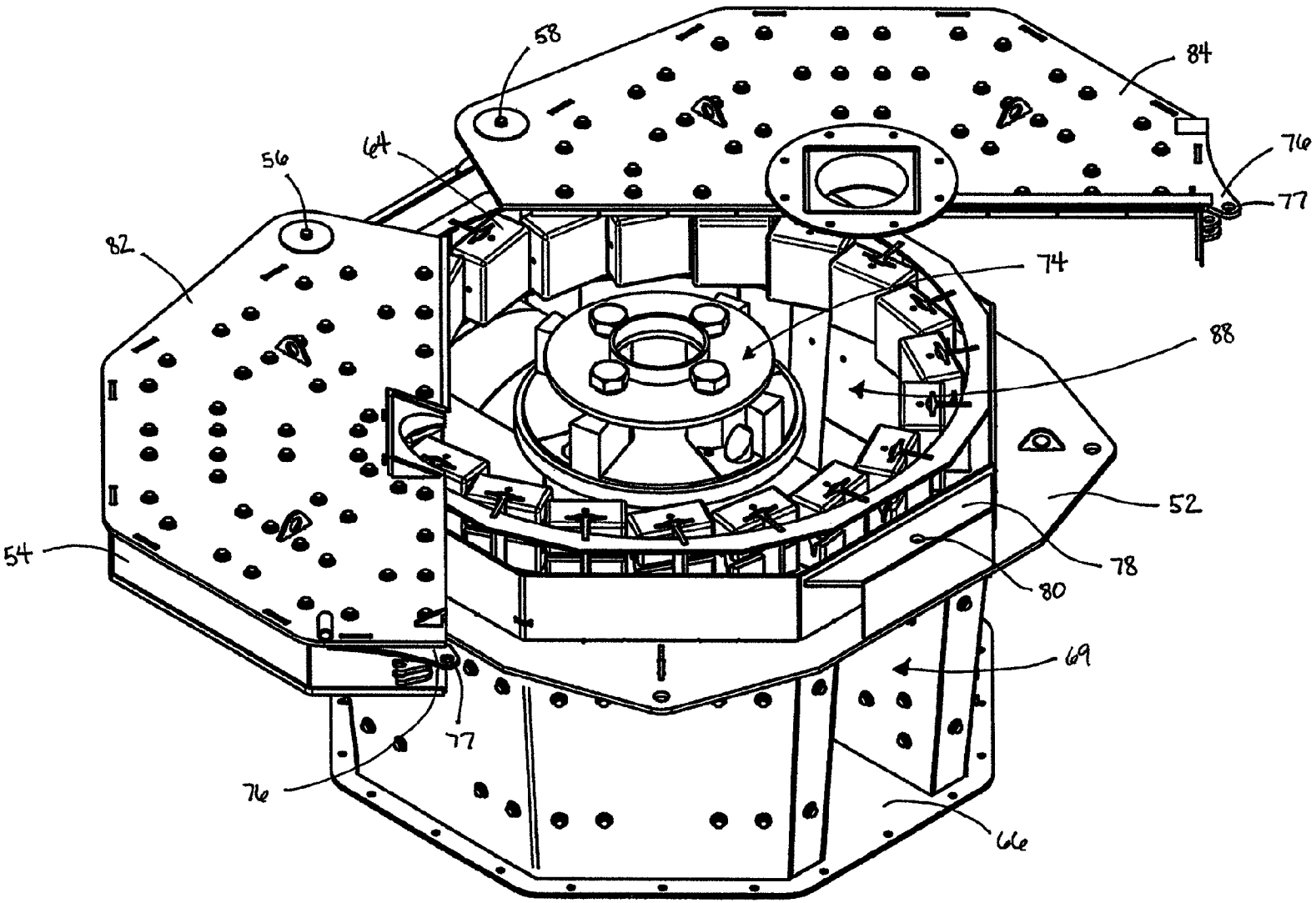
FIG. 4B is a perspective view of the impact crusher of FIG. 4A in an open position.

An exemplary embodiment of a VSI assembly that overcomes the disadvantages of the prior art is shown in FIGS. 4A-B and 5. In this embodiment, a VSI assembly 50 includes a low-profile housing 52. The advantages of the low-profile housing 52 will become apparent as the rest of the VSI assembly is described. The low-profile housing 52 is closed on top by a lid 54, which as shown in FIG. 4B, is a split lid. The split lid 54 has a first portion 82 that pivots about a first hinge assembly 56 and a second portion 84 that pivots about a second hinge assembly 58. The hinge assemblies 56, 58 are coupled to the low-profile housing 52 and allow the lid 54 to be spread apart from the center. This advantageously eliminates additional structure for lifting the lid, as required in the prior art embodiment shown in FIG. 1. In a different embodiment, the low-profile housing 52 includes the standard lid shown in FIG. 1 and would require additional structure for lifting the lid open.

In FIGS. 4A-B, the low-profile housing 52 has a discharge flange 66 that is positioned below the base. A crushing chamber 88 is defined within the housing and includes a rotor assembly 74 and a plurality of anvils 64. The low-profile housing 52 also encloses a drive unit 72, which has a cross-section that allows it to be inserted into the housing 52 from above (see FIG. 5A). In one embodiment, the drive unit 72 comprises an inline hydraulic motor and bearing cartridge operably coupled to drive a shaft 73. In a different embodiment, the drive unit 72 may include an electric motor, an engine, a battery-powered unit, or any other device that may supply sufficient power to drive the VSI assembly 50. The shaft 73 is connected to the rotor assembly 74 and provides power for rotating the rotor assembly 74.

Figure 5A:
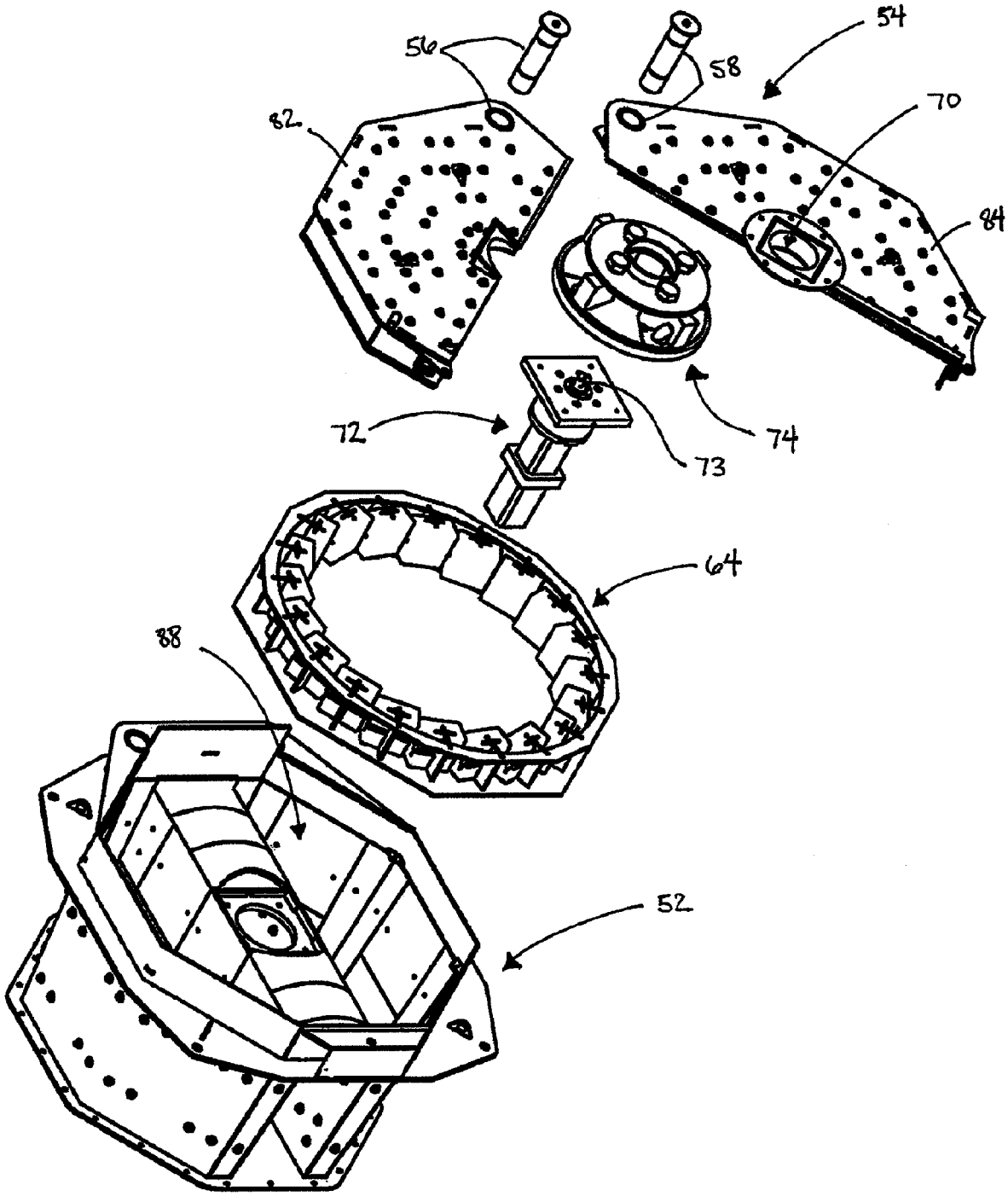
FIG. 5A is an exploded view of the impact crusher of FIG. 4A.

As previously described, the housing 8 of FIG. 1 encloses the bearing cartridge 22 and vertical shaft 26, and thus these and other enclosed components are subjected to being damaged by flying debris. Unlike the housing of FIG. 1, the low-profile housing 52 in FIGS. 4A-B and 5 encloses only those components required for crushing the material. As illustrated in FIG. 5A, the drive unit 72 and shaft 73 are advantageously positioned outside of the crushing chamber 88 and thus are protected from flying debris. In addition, the low-profile housing 52 includes a bearing cartridge (generally shown at 72) that is mounted near the rotor. For example, in one embodiment the bearing cartridge is mounted approximately 2.5 inches from the rotor assembly. Advantageously, the location of the bearing cartridge mounting plate relative to the rotor assembly reduces or eliminates the so-called "flag pole effect" with the low-profile housing 52. The effect of rotor imbalance is improved in the low-profile housing 52, for example, such that during operation, the rotor assembly does not have a large moment arm with which to shake the base.

Furthermore, in the embodiment described above that includes a hydraulic motor with the low-profile housing 52, a more compact VSI assembly 50 is constructed. As illustrated in FIGS. 1-3, the prior art VSI system 2 that includes the electric motor assembly 6 also requires the V-belt assembly 24. This design requires the VSI assembly 4 to be located adjacent to both the electric motor assembly 6 and the V-belt assembly 24 in order to maintain tension in the belts. In contrast to the VSI system 2 of FIGS. 1-3, the VSI assembly 52 shown in FIGS. 4-5 includes a more compact drive unit 72. Although the hydraulic motor requires both a hydraulic pump and electric motor (neither of which are shown) to supply hydraulic fluid, the hydraulic pump and electric motor can be positioned in a remote location and pipes can run between these components to supply the fluid. This arrangement can save floor space and provide a more compact VSI assembly.

Figure 5B:
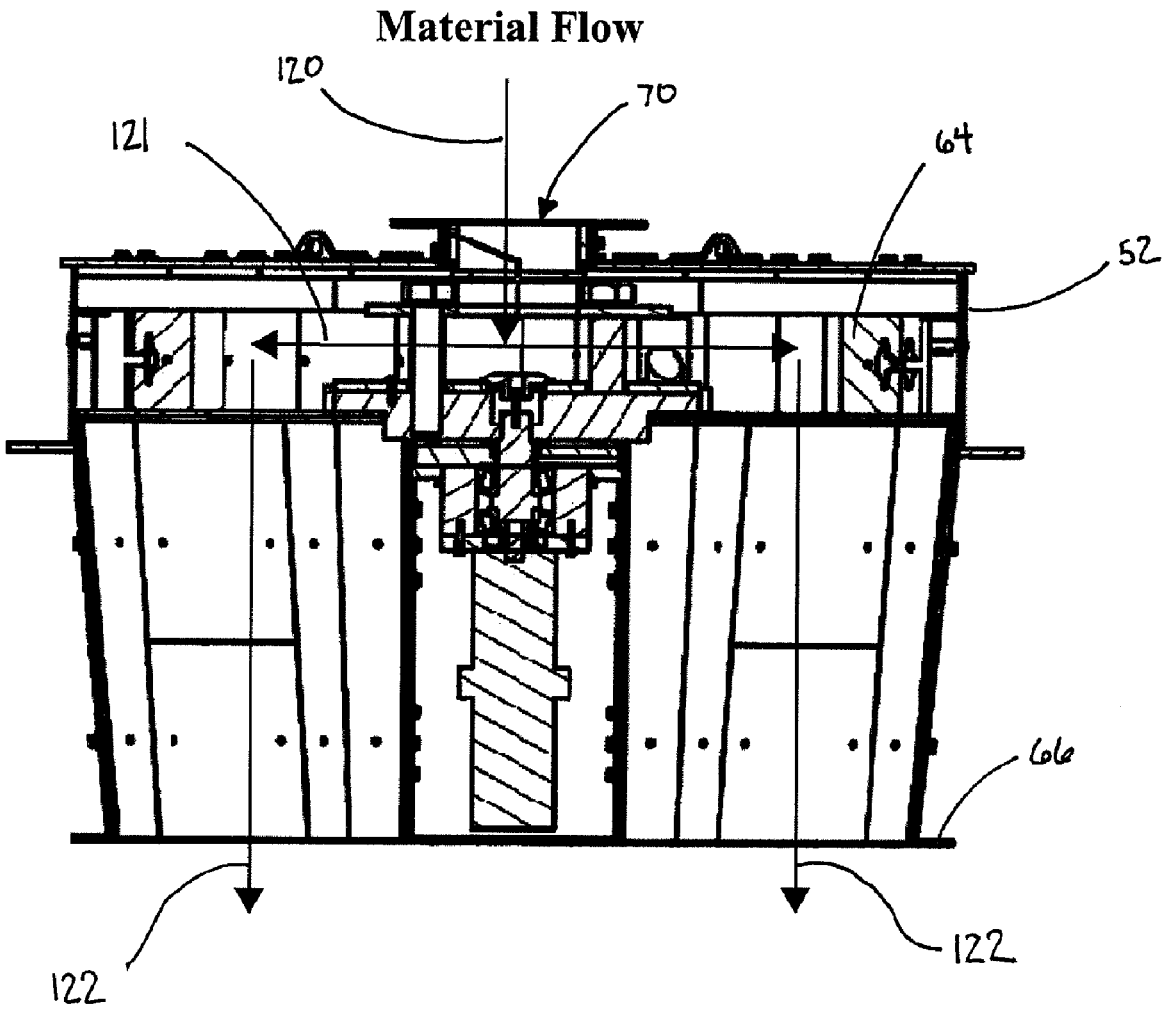
FIG. 5B is a schematic view from the side of the impact crusher of FIG. 4A showing the material flow through the impact crusher.

In the embodiment shown in FIGS. 4A-4B and 5A, the second portion 84 of the lid 54 includes a central opening 70 in which material that is dispensed from a hopper (not shown) passes through the central opening 70 and into the housing 52. The material generally follows along path 120 as shown in FIG. 5B. The first portion 82 and second portion 84 each have a tongue 76 with a hole 77. The housing 52 also has a tongue 78 with a hole 80. When the lid 54 is closed, as illustrated in FIG. 4A, a heavy duty clamp 79 is used to securely hold the first portion 82 and second portion 84 together. Additional means such as a bolt or pin 68 can be inserted into the corresponding holes 77, 80 of each tongue 76, 78 to hold the lid 54 closed.

Once the material passes through the central opening 70, it enters the crushing chamber 88 (see FIG. 4B). The crushing chamber 88 has a central region and an outer periphery. The rotor assembly 74 is positioned within the central region and has an internal opening in which the material enters. The rotor assembly 74 rotates about an axis that extends through the center of both the internal opening and the central opening 70.

The rotor assembly 74 throws the material radially outward along path 121 from the internal opening to the outer periphery of the chamber 88 where the material collides with an outer impact surface or anvils 64. The rotor assembly 74 uses centrifugal forces to throw the material at high speeds and, upon contact with the outer impact surface or anvils 64, the material breaks apart. In the embodiment of FIG. 4B, anvils 64 are positioned about the outer periphery of the crushing chamber 88 such that the anvils 64 circumscribe the rotor assembly 74. Once the material is broken apart into smaller pieces, a discharge chute 69 disposed at the bottom of the housing 54 helps guide the material out of the housing 54 along path 122 (see FIG. 5B).

Figure 6:
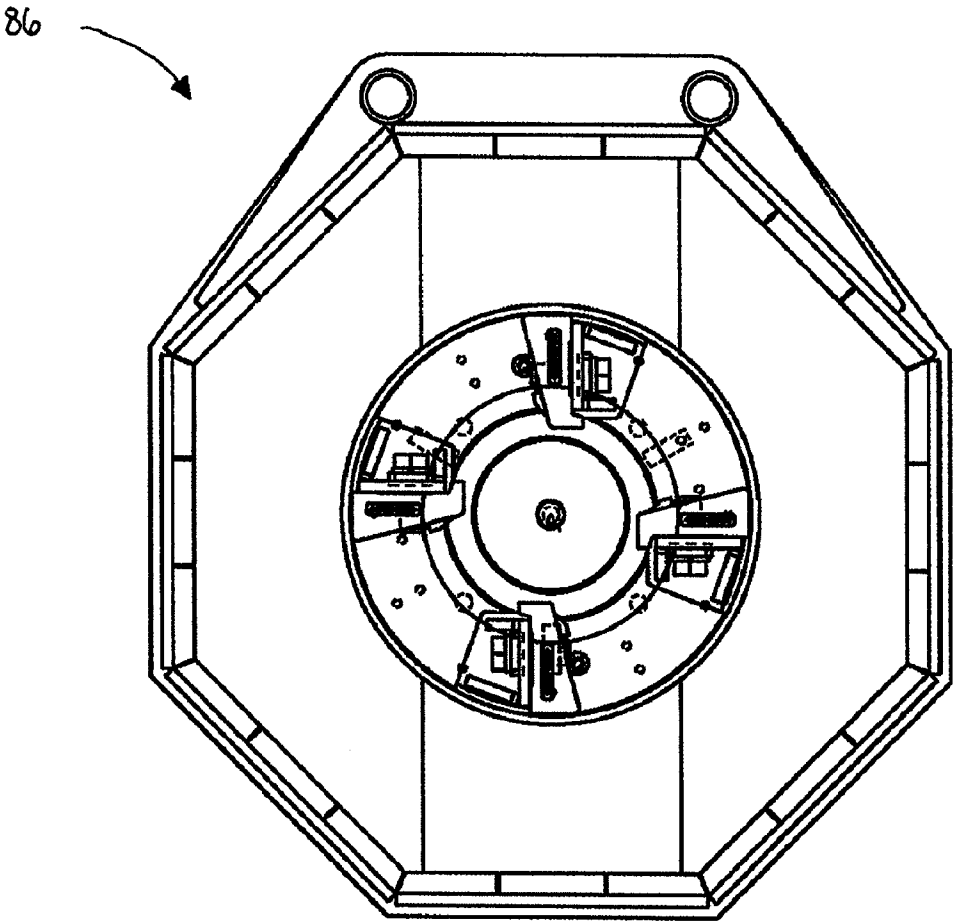
FIG. 6 is a top view of an impact crusher having a low-profile housing and a split lid in the shape of an octagon.
Figure 7:
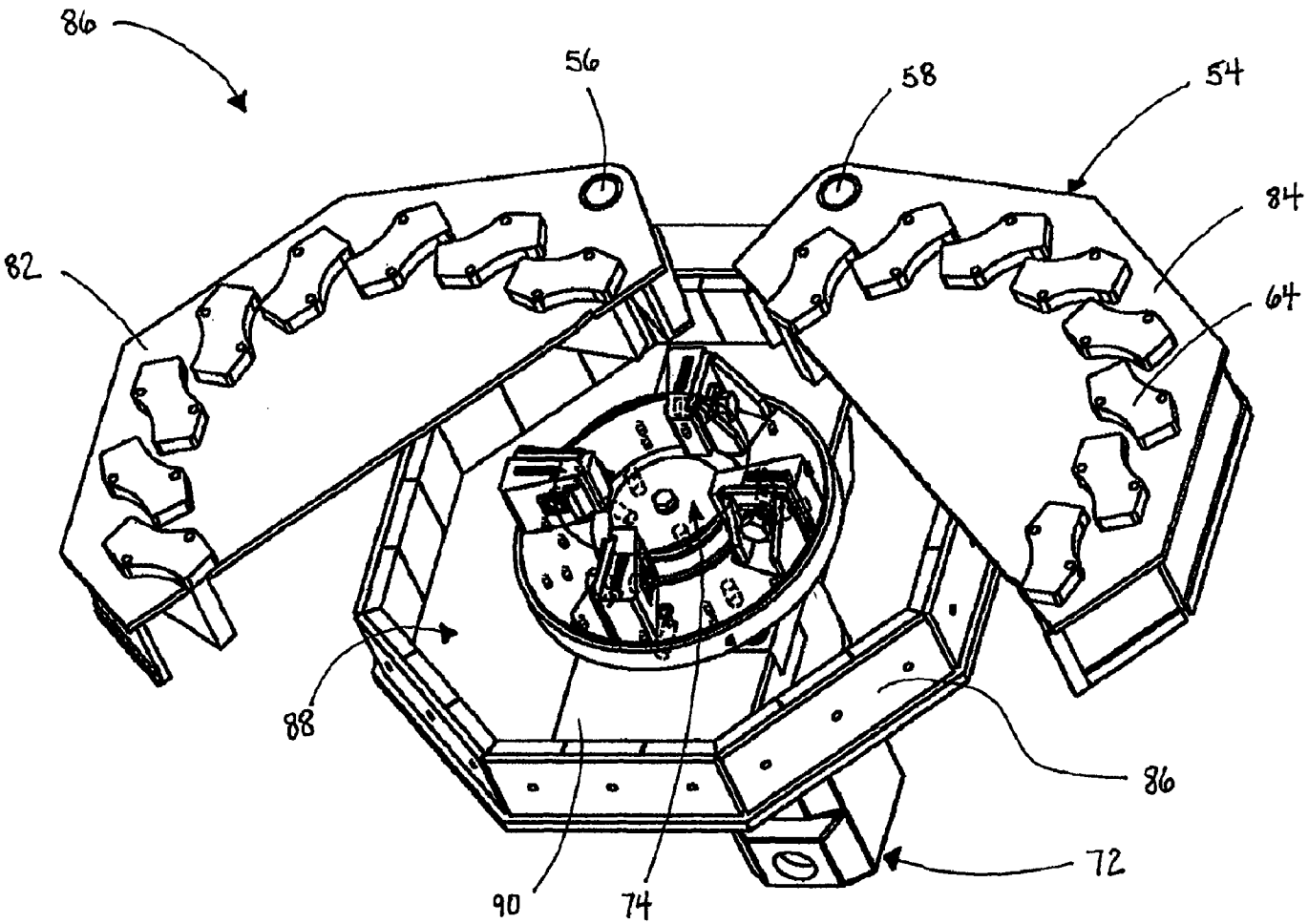
FIG. 7 is a perspective view of the impact crusher of FIG. 6 in which the split lid is in an open position.
Figure 8:
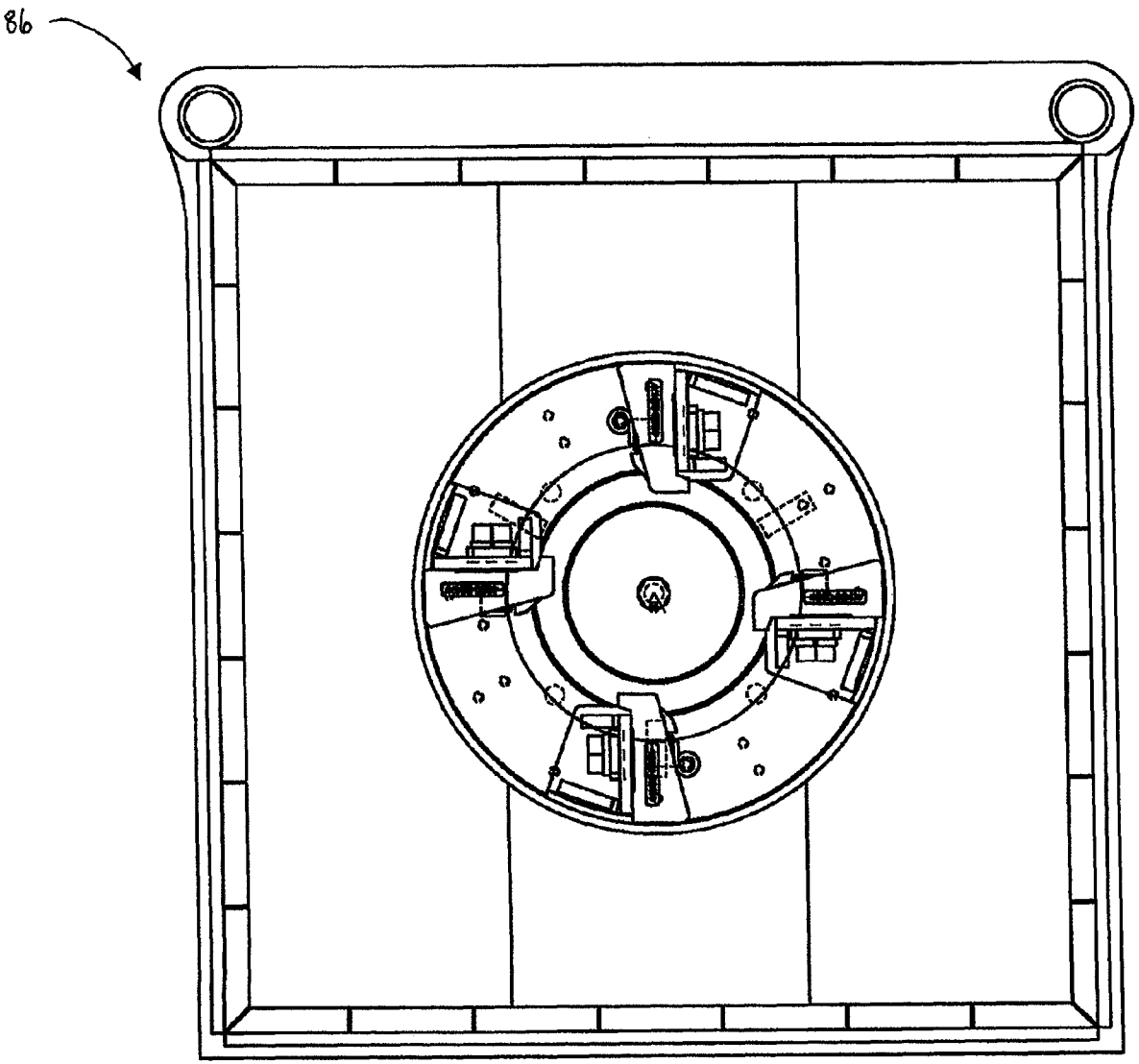
FIG. 8 is a top view of an impact crusher having a low-profile housing and a split lid in the shape of a square.
Figure 9:
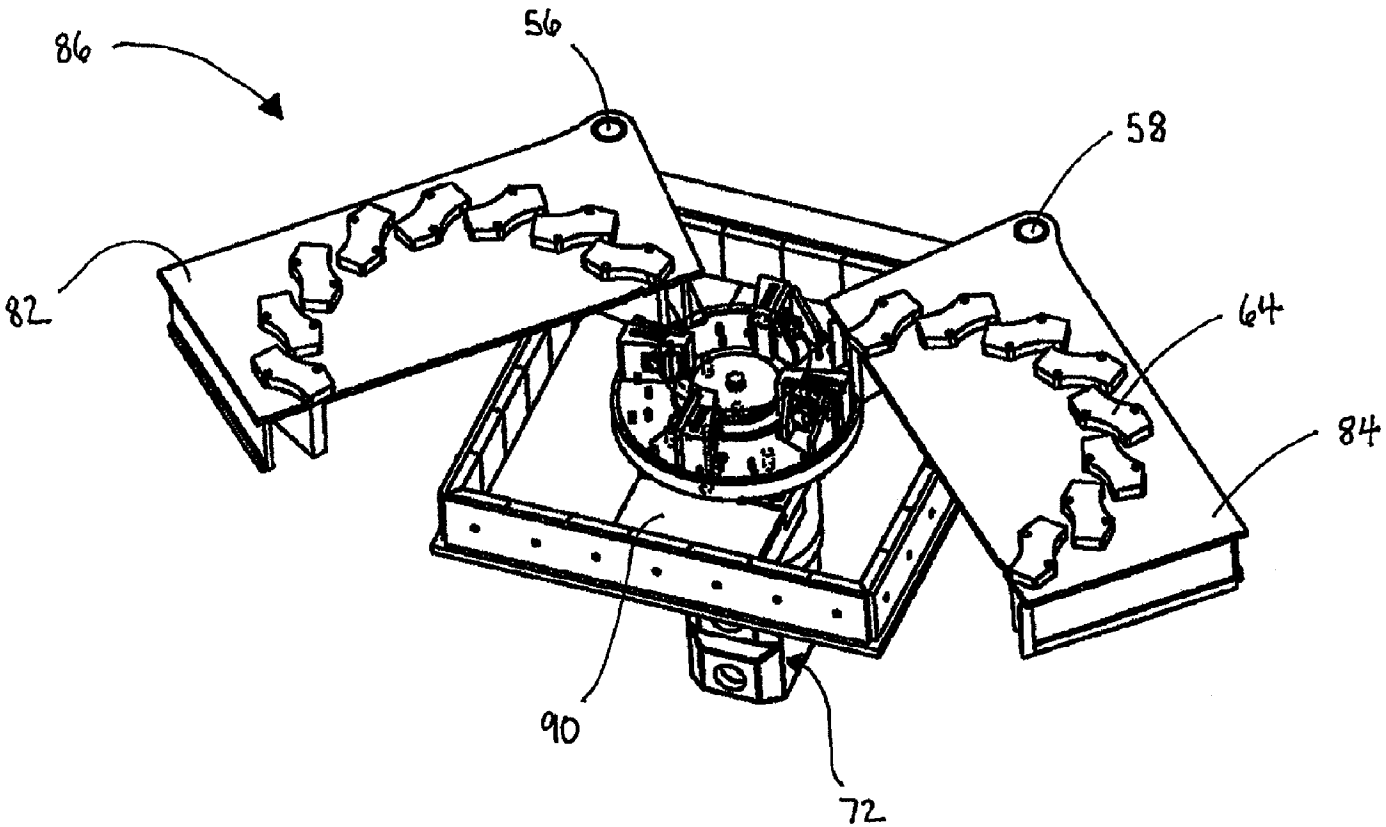
FIG. 9 is a perspective view of the impact crusher of FIG. 8 in which the split lid is in an open position.
Figure 10:
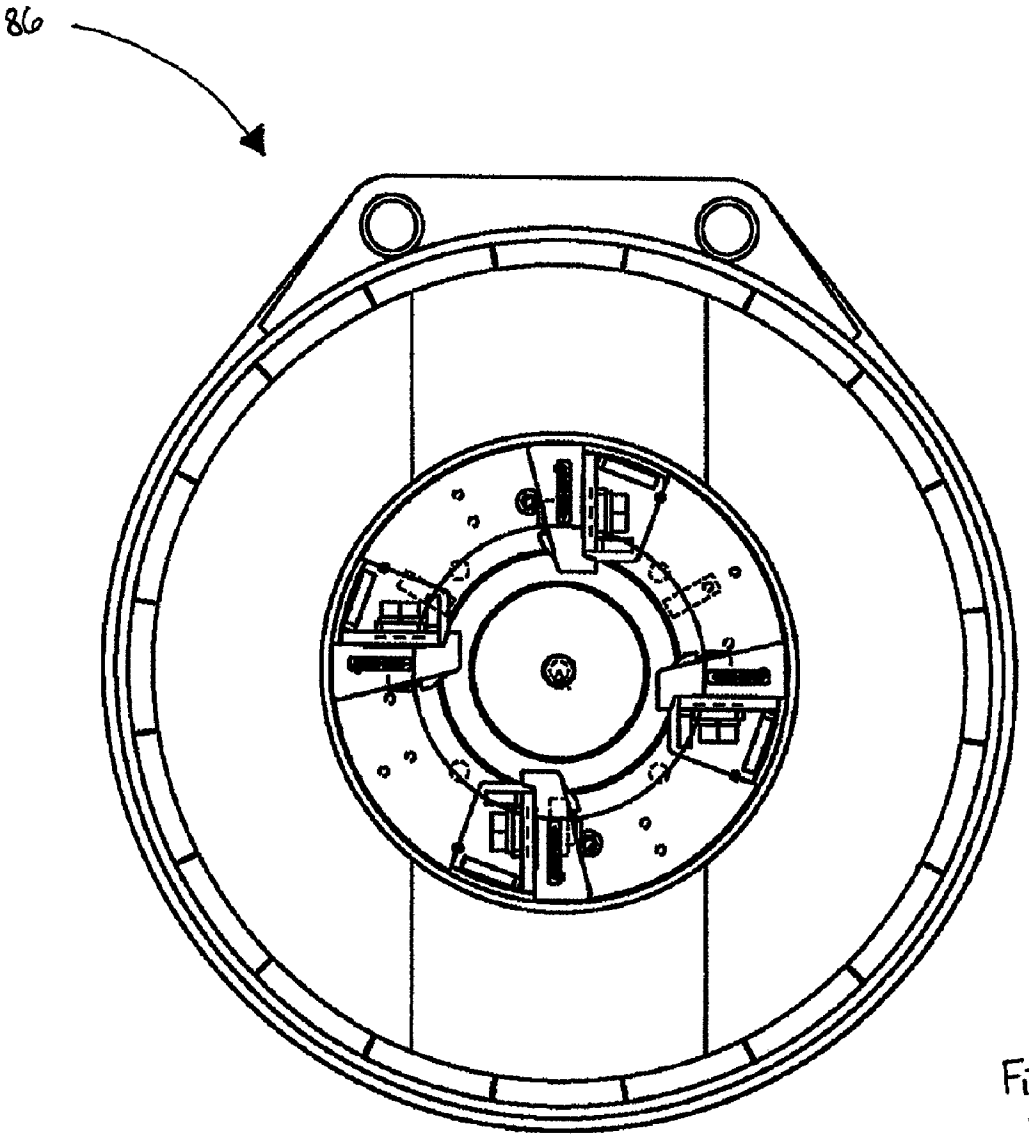
FIG. 10 is a top view of an impact crusher having a low-profile housing and a split lid in the shape of a circle.
Figure 11:
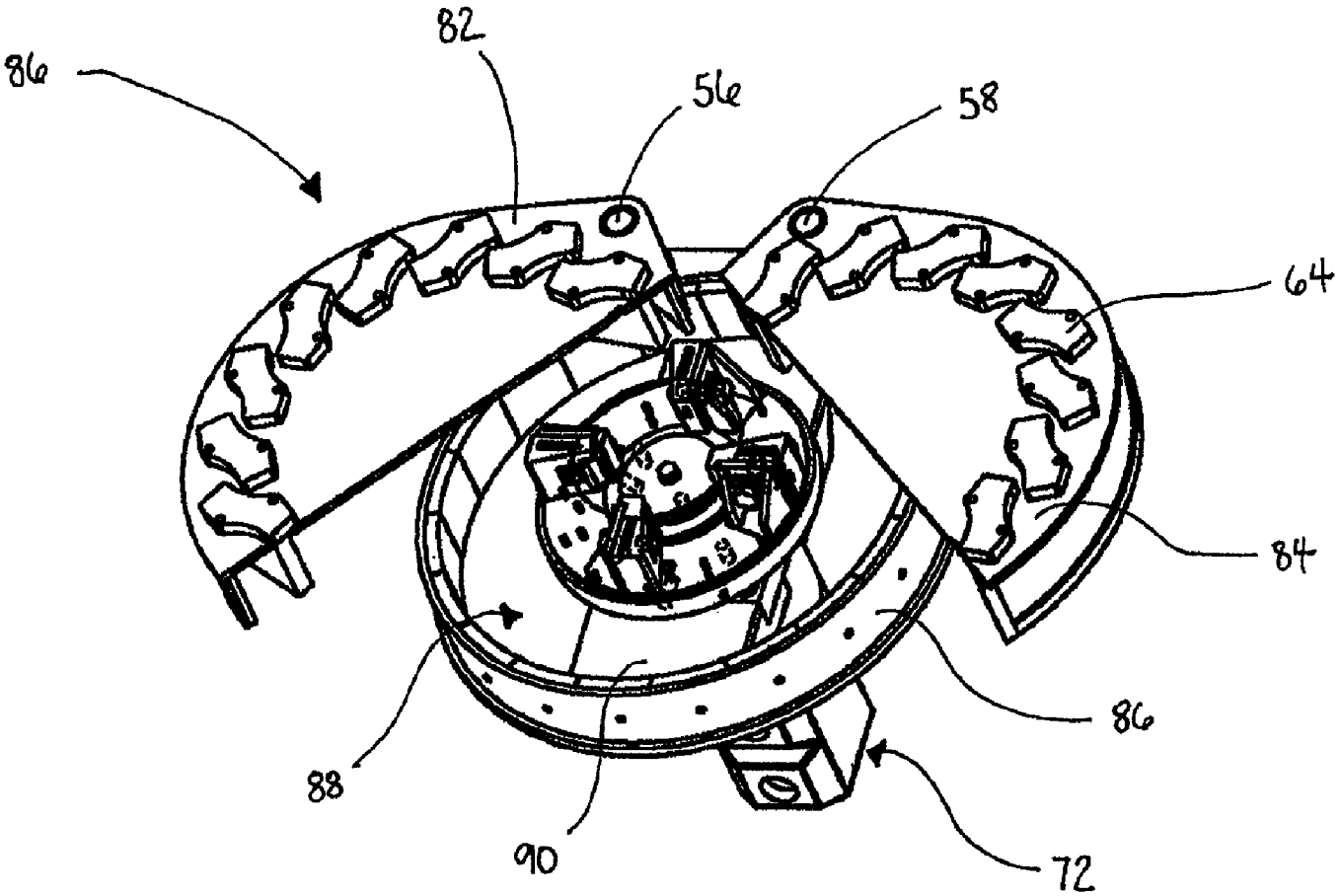
FIG. 11 is a perspective view of the impact crusher of FIG. 10 in which the split lid is in an open position.
Figure 12:
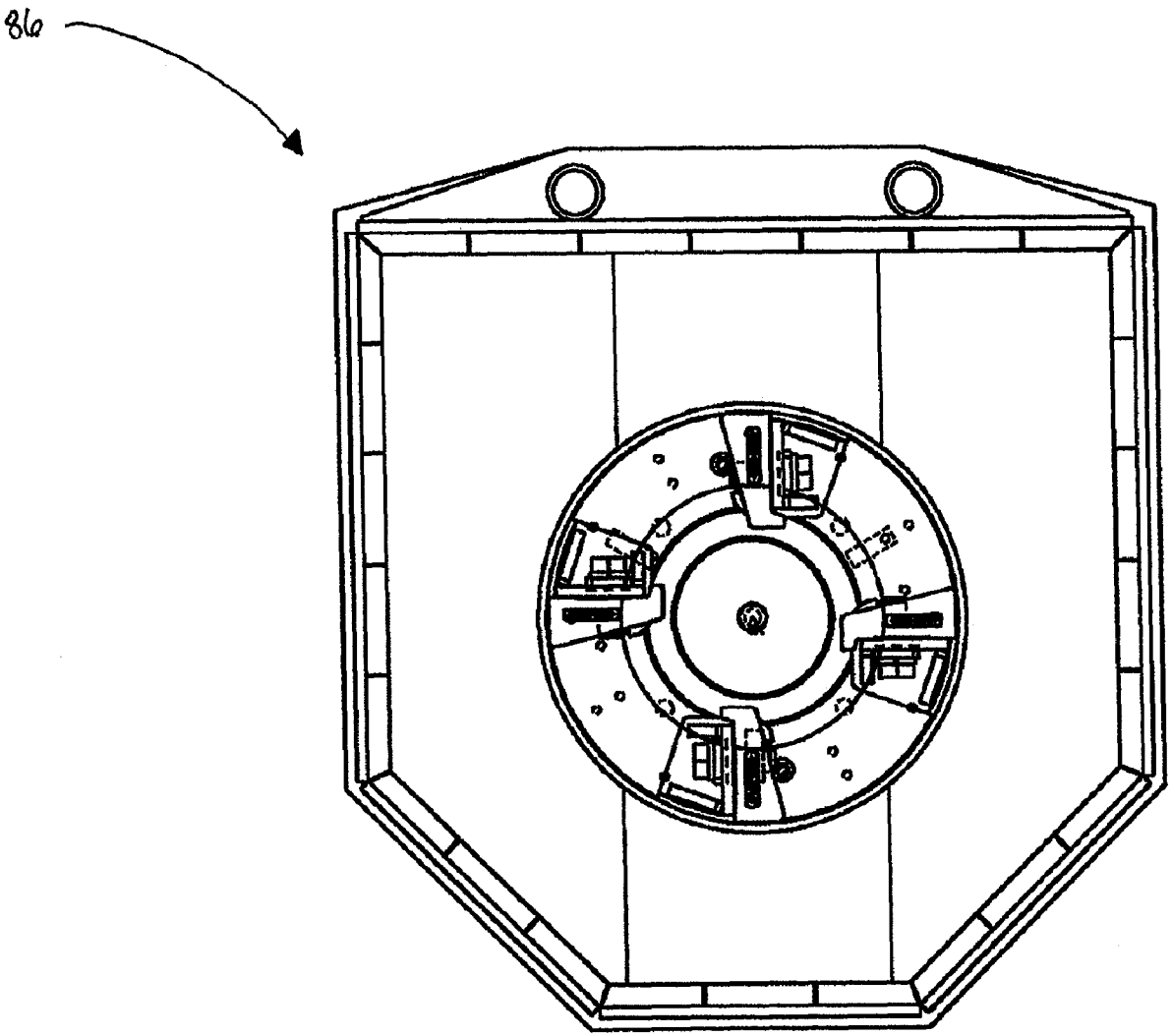
FIG. 12 is a top view of an impact crusher having a low-profile housing and a split lid in the shape of a hexagon.
Figure 13:
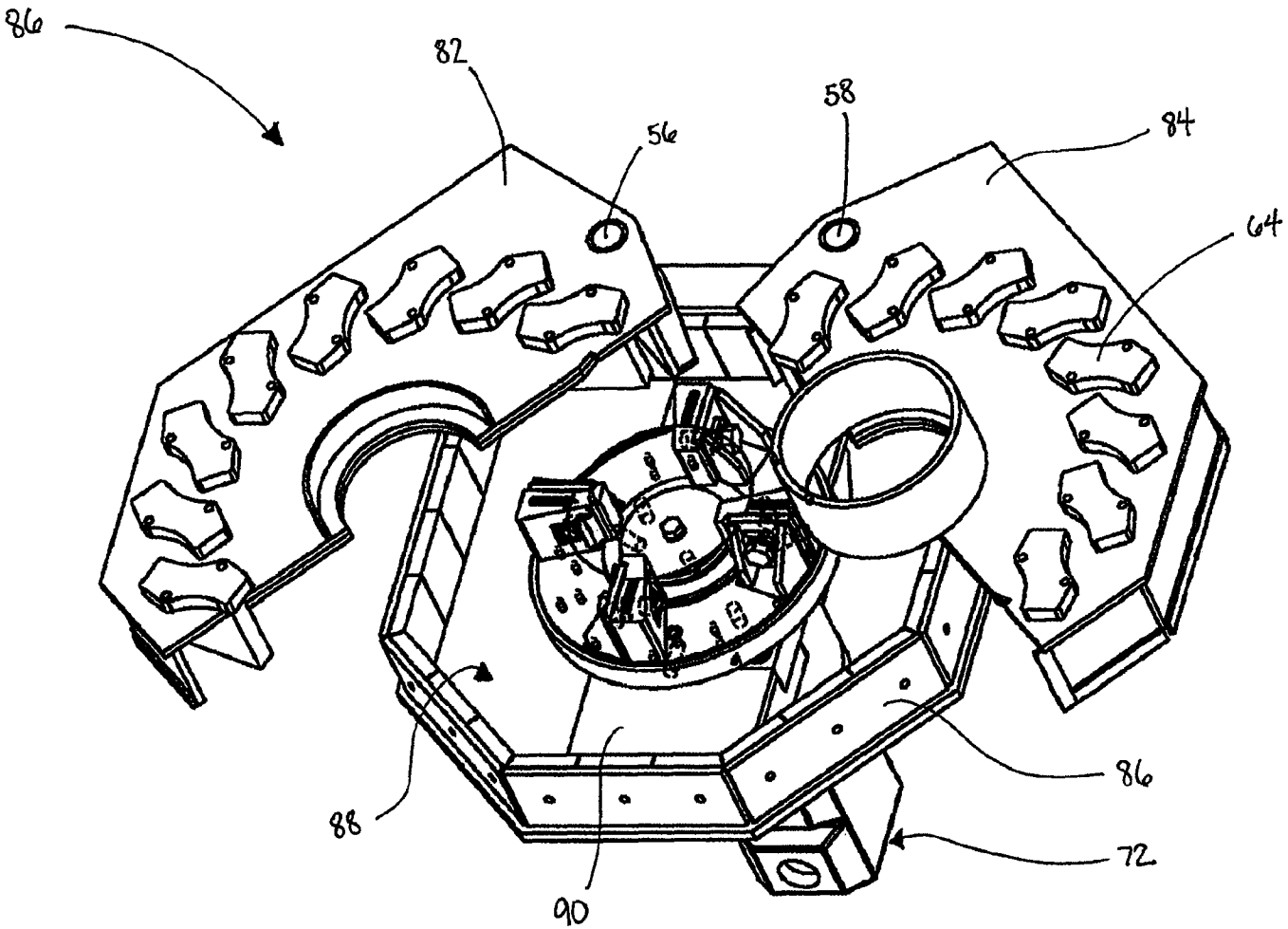
FIG. 13 is a perspective view of the impact crusher of FIG. 12 in which the split lid is in an open position.

In the embodiment shown in FIGS. 6-7, a low-profile housing 86 has an octagonal shape. Different embodiments of the low-profile housing 86 are also shown as being square (FIGS. 8-9), circular (FIGS. 10-11), and hexagonal (FIGS. 12-13). The shape of the low-profile housing 86 can be other shapes as well, including rectangular, pentagonal, oval, and any other shape that meets the description requirements contained herein. The shape of the first portion 82 and second portion 84 of the lid correspond to the shape of the low-profile housing 86.

In FIG. 7, the arrangement of the components within the low-profile housing 86 is shown with the first portion 82 and second portion 84 of the split lid configuration spread apart in the open position. The crushing chamber 88 is defined from above by both the first portion 82 and second portion 84 of the lid 54, from below by a bottom surface 90, and on the edges by the outer walls of the housing 86. With the bottom surface 90 surrounding the rotor assembly 74, material that deflects away from the anvils 64 cannot interfere with and damage the drive unit 72. The bottom surface 90 is part of the base. In FIGS. 7, 9, 11, and 13, a portion of the bottom surface 90 is removed to further illustrate the drive unit 72 being disposed outside of the crushing chamber 88 and protected from any flying debris. Instead, the material exits along path 122 from the crushing chamber 88 and slides down along the periphery of the inside of the VSI assembly 86 into the discharge chute 69. The discharge chute 69 may include two cavities for material to flow through, one on each side of the cavity of the bearing cartridge. At the bottom of the discharge chute 69, the discharge flange 66 has tow openings for material to exit the VSI assembly 86.

Figure 14:
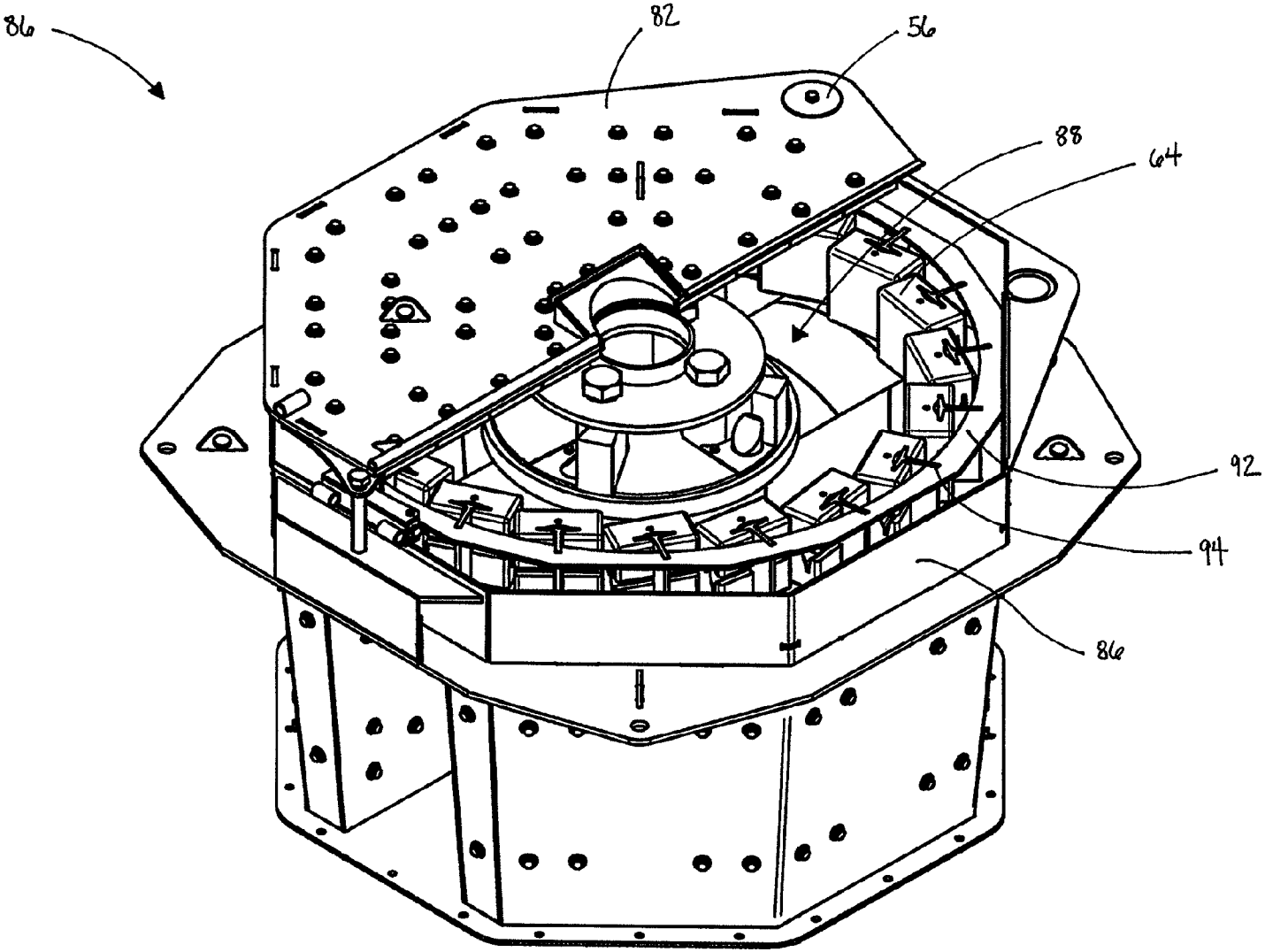
FIG. 14 is a perspective view of an impact crusher having a split lid and a standard anvil ring.
Figure 15:
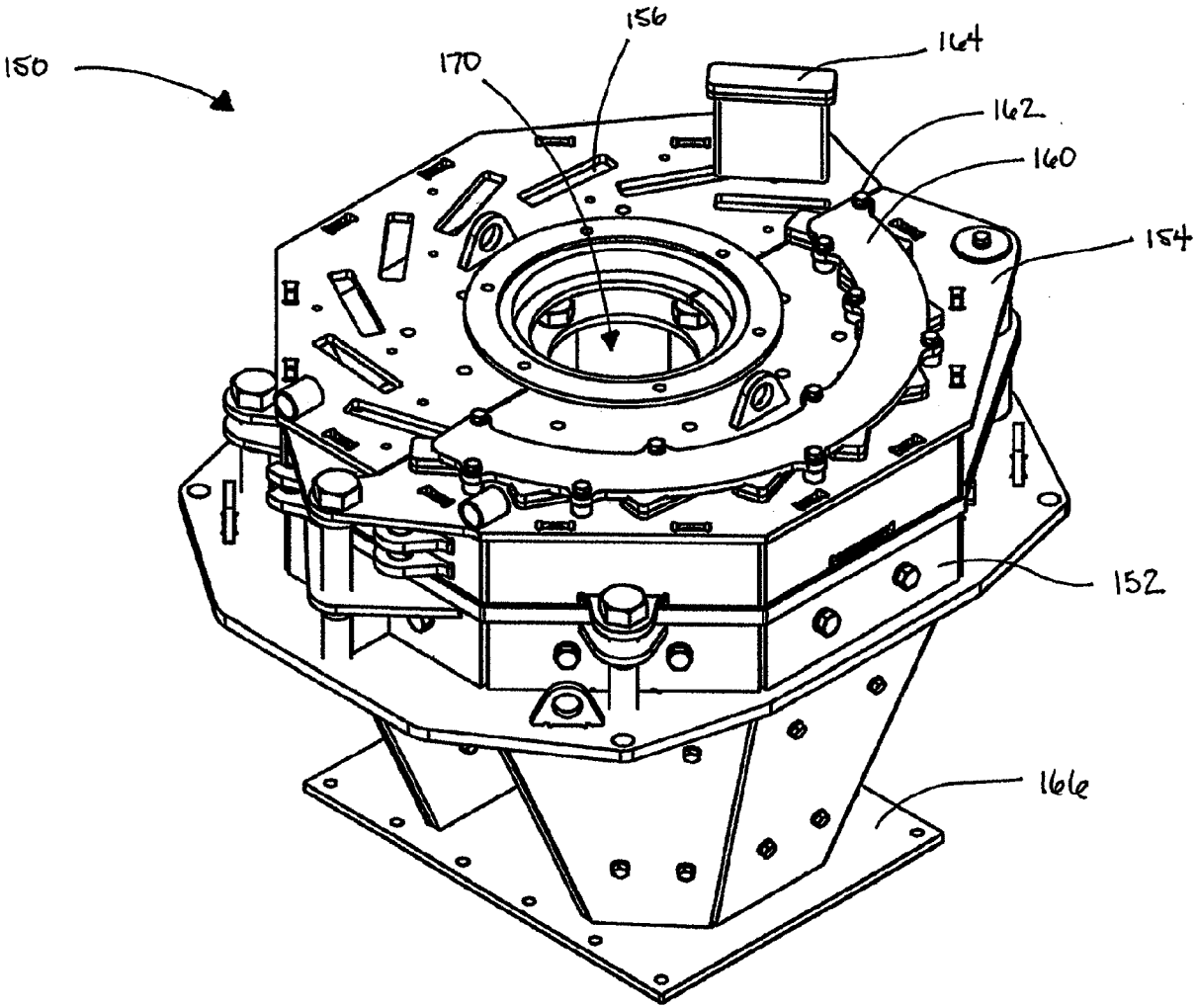
FIG. 15 is a perspective view of an impact crusher having a split lid with openings for receiving anvils and a plate for securing the anvils to the lid.
Figure 16:
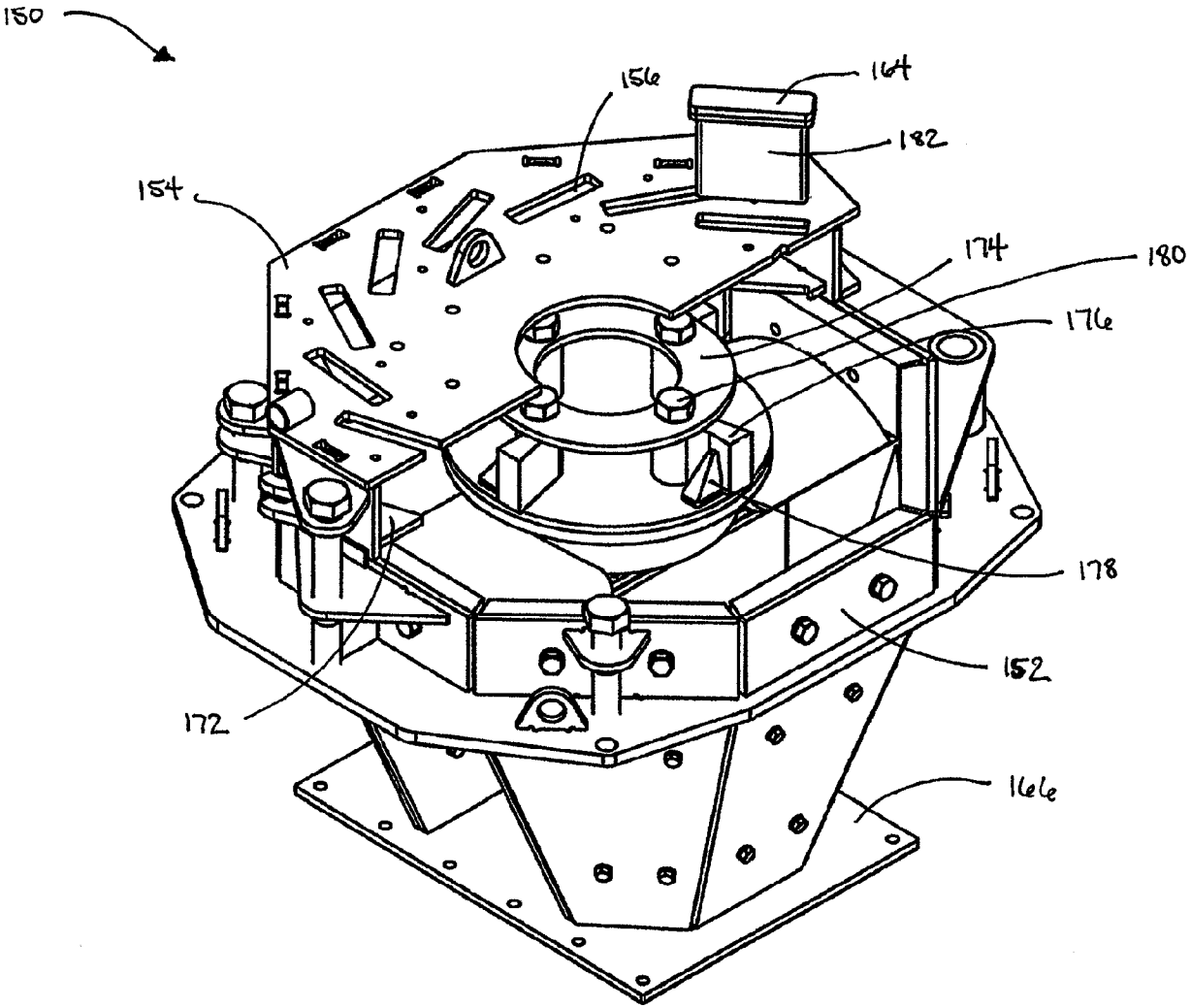
FIG. 16 is a perspective view of the impact crusher of FIG. 15 in which one portion of the split lid is removed to show a crushing chamber and a rotor assembly.
Figure 17:
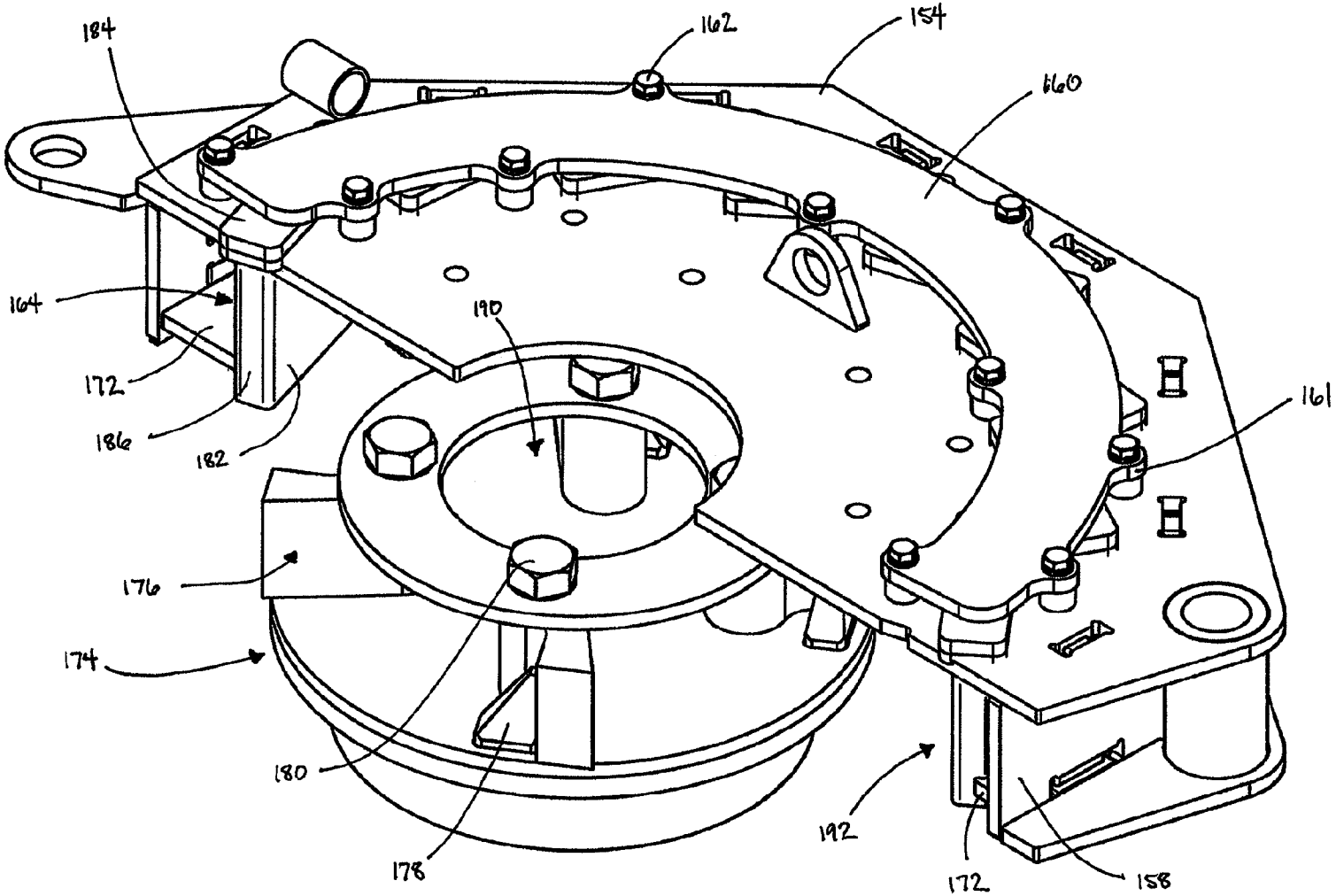
FIG. 17 is a partial perspective view of a split lid with openings for receiving anvils and a plate for securing the anvils to the lid.
Figure 18:
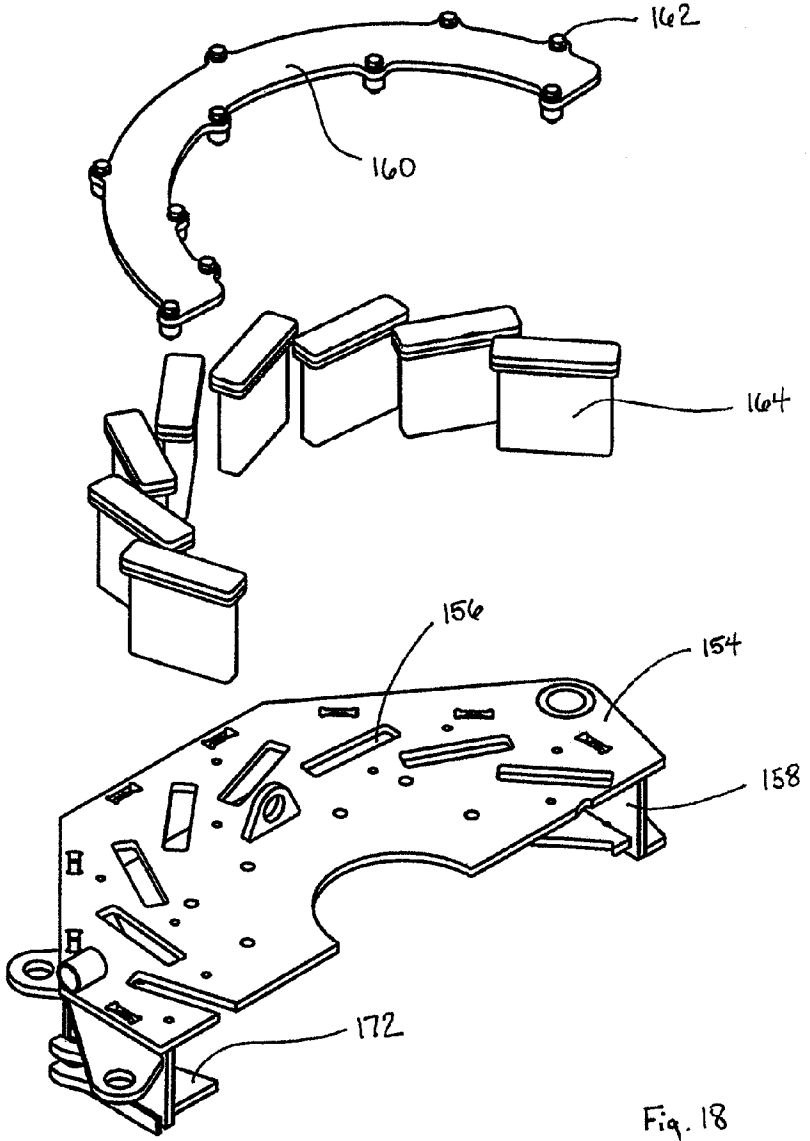
FIG. 18 is an exploded view of the split lid of FIG. 17.

The VSI assembly 86 shown in FIG. 14 includes a standard anvil ring 92 for securing anvils 64 about the outer periphery of the low-profile housing 86. In this embodiment, a coupler 94 is used to secure the anvil 64 to the anvil ring 92. The coupler 94 may be a portion of the anvil 64 and it may slide within a groove of the anvil ring 92. Alternatively, the coupler 94 may be a part of the anvil ring 92 such that it slides into a slot or groove (not shown) in the anvil 64. As illustrated in FIG. 14, the coupler 94 is in the shape of a "T". Although the VSI assembly 86 is shown with a split lid, other embodiments of the VSI assembly 86 have variations of lids including the lift lid as illustrated in FIG. 1.

Figure 19B:
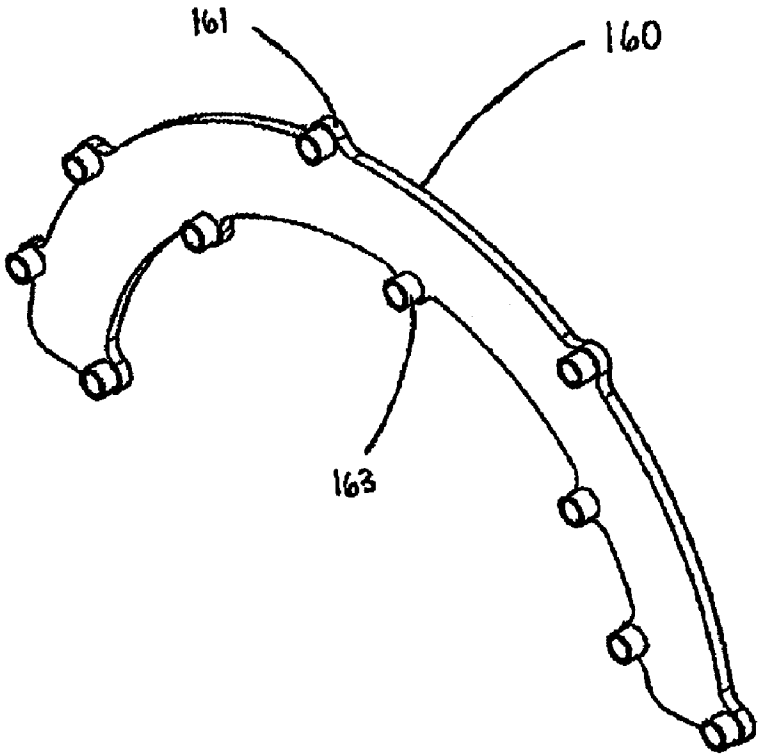
FIG. 19B is a perspective view of the bottom of the plate of FIG. 17.

In the exemplary embodiment shown in FIGS. 15-18, a VSI assembly 150 comprises a housing 152 having a lid 154 and a discharge flange 166, which is disposed below a base. A central opening 170 is positioned near the middle of the lid 154 to allow material dispensed from a hopper (not shown) to enter into a crushing chamber 188. The lid 154 also includes a plurality of openings or receptacles 156 dispersed about the perimeter of the top surface of the lid. Anvils 164 can slide into the openings or receptacles 156 and are secured to the lid 154 by a plate 160. The openings or receptacles 156 are oriented at various angles with respect to the center of the crushing chamber, and the openings or receptacles 156 are generally rectangular in shape. However, the openings or receptacles 156 can be any shape to fit the cross-section of the anvils 164. The plate 160 is generally made of a metallic material, but any suitable material is possible so long as the anvils 164 are securely supported by the lid 154. Additionally, in one embodiment, the plate is arcuate and contains tabs 161 (see FIGS. 17 and 19B) that protrude from the inner and outer diameter of the plate 160. The plate 160 is fastened to the lid 154 by fasteners 162, which slide into openings in the tabs and advantageously screw into the lid 154.

In an advantageous embodiment, the length of the plurality of openings or receptacles 156 is longer than its width, and the length is oriented perpendicular to the direction in which material is thrown from the rotor assembly 174. In other words, the material is thrown radially outward from the rotor assembly 174. When the lid 154 is closed and the plurality of anvils 164 are positioned in the openings or receptacles 156, an impact surface 182 of the plurality of anvils 164 is oriented perpendicular to the direction in which the material is thrown from the rotor assembly 174. Therefore, solid contact is made between the impact surface 182 and the material, thereby causing the material to break apart upon impact.

Figure 19A:
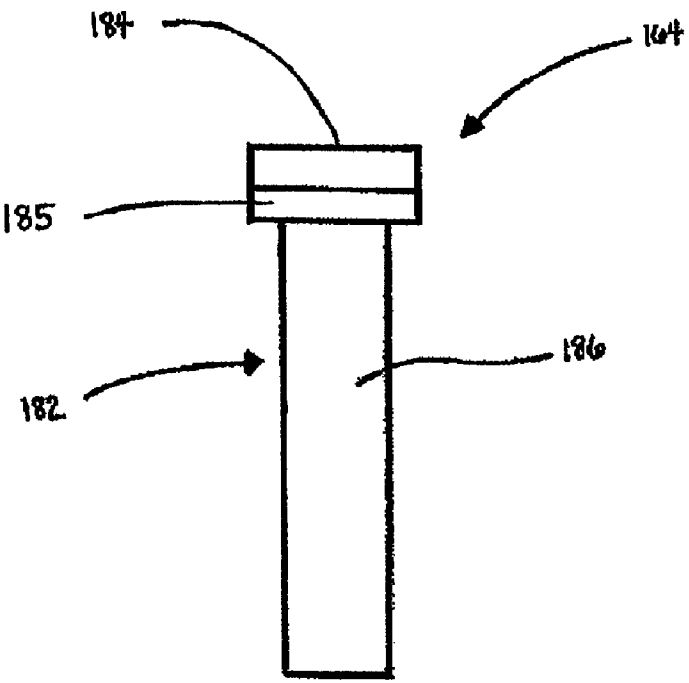
FIG. 19A is a side view of an anvil that is slideably received in the openings of the split lid of FIG. 17.
Figure 2D:
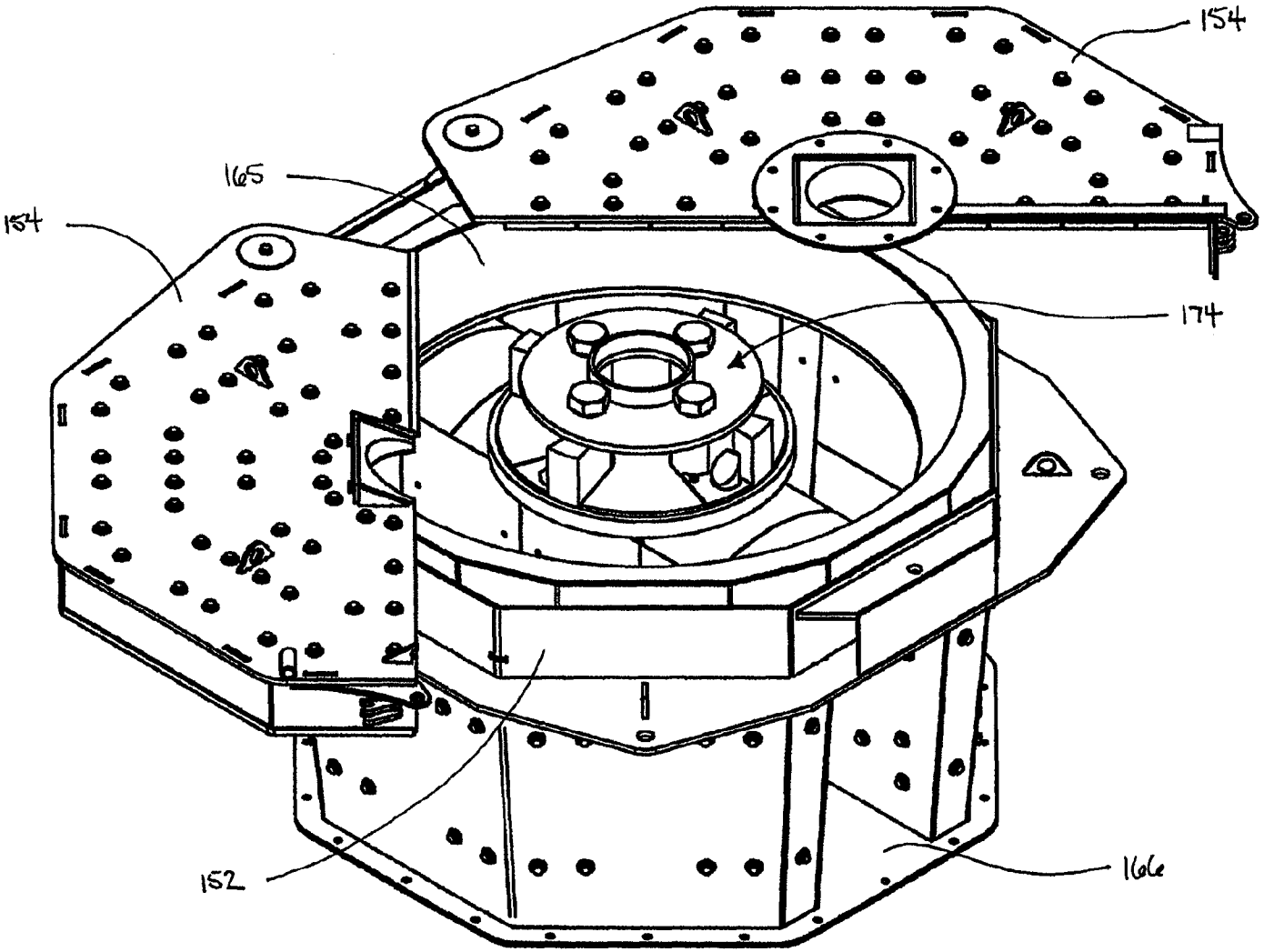

The anvils 164 are generally solid blocks of metal with the impact surface 182 oriented toward the center of the rotor assembly 174. As described above, material contacts the impact surface 182 and breaks apart. As shown in FIG. 19A, the anvil 164 has a top portion or flange 184 and a bottom portion 186. As the anvil 164 is slid or dropped into the receptacle 156, the bottom portion 186 hangs within the crushing chamber 188 as the top portion or flange 184 rests against the top surface of the lid 154. Generally, a gasket or similar layer 185 is placed between the top portion or flange 184 of the anvil 164 and the top surface of the lid 154 to prevent dust and other substances from escaping through the openings or receptacles 156. An individual gasket 185 may be used for each anvil 164, or a large gasket that fits a substantial portion of the top surface area of the lid may be used. In a different embodiment, the bottom portion 186 of the anvil 164 may rest against the bottom surface of the crushing chamber 188 rather than hang from the lid 154.

The advantage of sliding or dropping the anvils 164 into the openings or receptacles 156 of the lid 154 from above is it allows the anvils 164 to be easily accessible and removable. Unlike the embodiment of FIG. 14, where the anvils 64 are held by the anvil ring 92 inside the crushing chamber 88, the anvils 164 in the embodiment of FIGS. 15-18 are secured by the plate 160 outside of the crushing chamber 188. This configuration allows the anvils 164 to be removed without having to open the lid and thereby improves the accessibility of the anvils for maintenance reasons.

The plate 160 presses down on the top portion or flange 184 of the anvils 164 to compress the gasket 185. However, the plate 160 cannot be overtightened, because stoppers or bumpers 163 (see FIG. 19B) are welded to the bottom side of the plate 160 to limit the amount of compression. The stoppers or bumpers 163 are advantageously positioned below each of the tabs 161 of the plate 160. With the anvils 164 being held securely within the openings or receptacles 156, the anvils are not able to move out of the openings or receptacles. However, enough play is provided such that the anvils 164 can pivot on the gasket 185 as material within the crushing chamber 188 collides against the impact surface 182 of the anvils 164. If the plate 160 was to be overtightened and the anvils 164 were secured too tightly to the lid 154, the lid 154 would be unable to withstand the bending moment caused by the material impacting the anvils 164. Instead, the majority of the force inflicted by the material on the anvils 164 is absorbed by a shelf 172 attached to the back wall 158 of the housing 152 (see FIG. 17). The shelf 172 may extend from the back wall 158 and contact the backside of the anvils 164, but in many instances there is a gap between the anvil 164 and the shelf 172. The shelf 172 provides support to the anvils 164 and reduces the bending moment inflicted on the anvils 164 during impact. The shelf may be integrally formed with the housing.

Although the VSI assembly 150 of FIGS. 15-18 is shown as an embodiment with the low-profile housing and the split lid including anvils that slide or drop into the lid, other embodiments are possible. For example, the prior art VSI assembly shown in FIG. 1 may also include a lid with openings or receptacles in which anvils slide or drop down therein.

As described above and shown in FIGS. 16-17, the rotor assembly 174 is provided for throwing material that passes through the central opening 170 with significant force against the anvils 164 for breaking apart the material. The rotor assembly 174 is positioned within an internal region 190 of the crushing chamber 188 and includes a plurality of shoes 176 that abut against stoppers 178. The shoes 176 rotate and throw the material radially outward from the internal region 190 to the outer periphery of the crushing chamber 192. The stoppers 178 prevent the shoes 176 from pivoting in an opposite direction and provide support to the shoes 176. The shoes 176 are coupled to the rotor assembly 174 by fasteners 180 and are able to pivot about the fasteners 180. The pivoting shoes are described in more detail below.

Figure 21B:
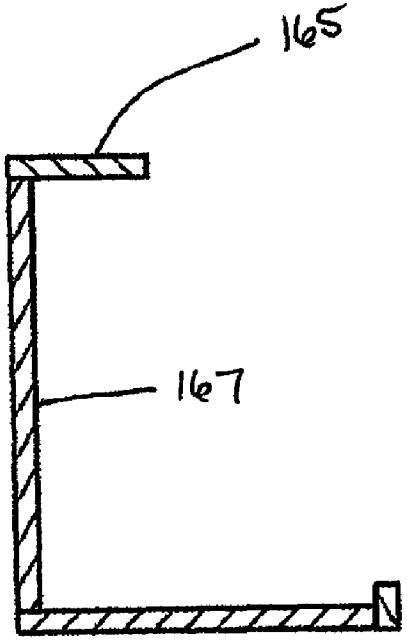
FIG. 21B is a cross-sectional view of the rock shelf of FIG. 21A.
Figure 21A:
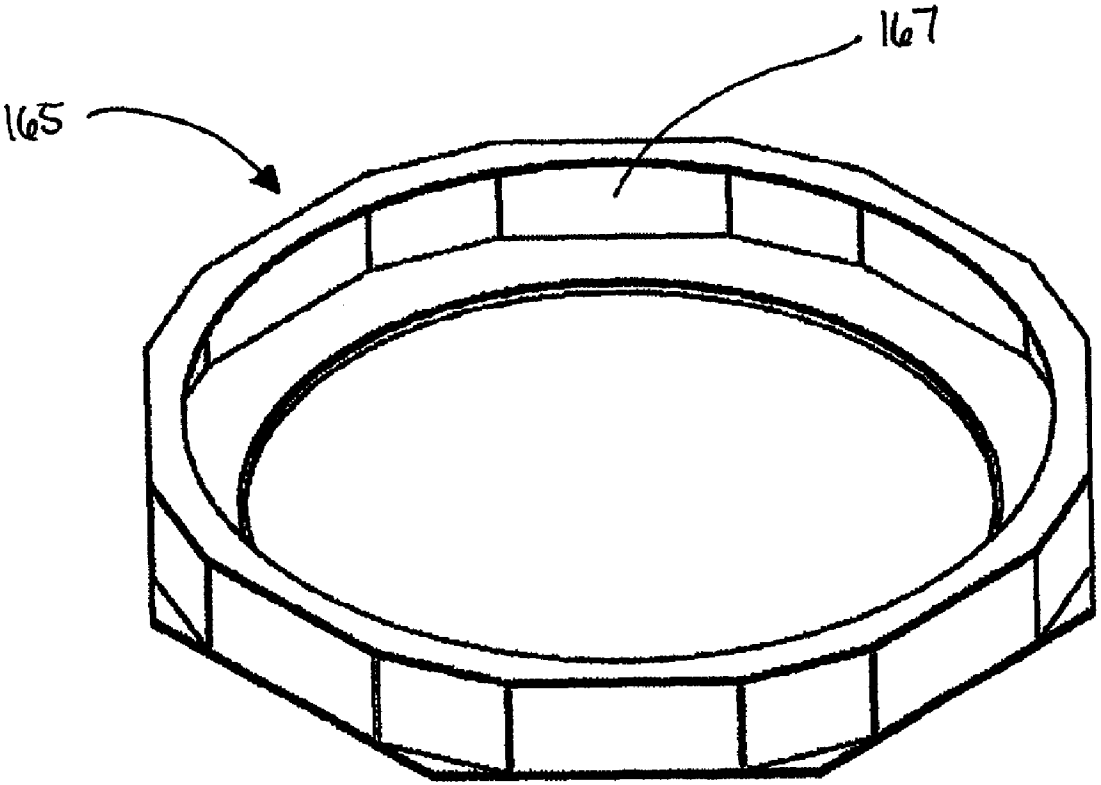
FIG. 21A is a perspective view of a rock shelf.
Figure 22:
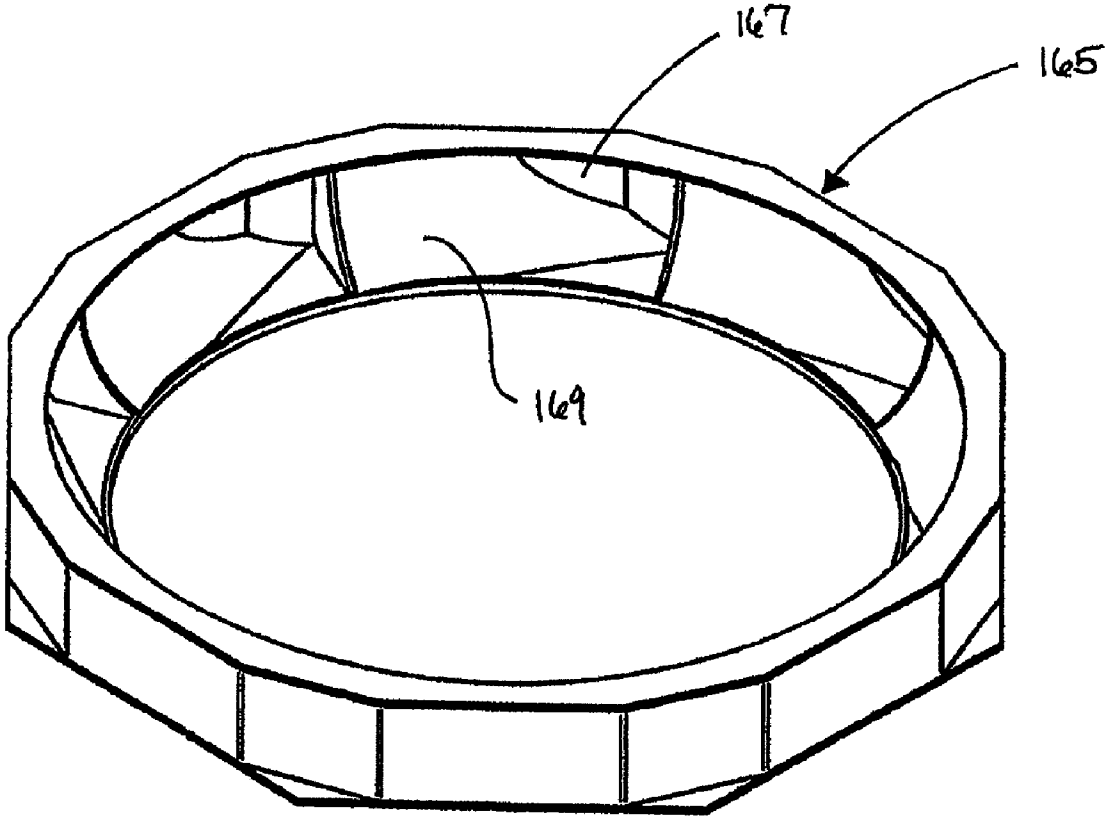
FIG. 22 is a perspective view of the rock shelf of FIG. 21A with material buildup.

Another embodiment of the VSI assembly is illustrated in FIGS. 20-22. Rather than having anvils dispersed about the perimeter of the crushing chamber, a rock shelf 165 is provided for breaking apart materials. As shown in FIGS. 21A-B, the rock shelf 165 has an inner surface 167 in which material tends to buildup against. As material builds along this rock shelf 165, new material is thrown from the rotor assembly 174 and it collides with the material buildup 169 (see FIG. 22). The material buildup 169 is continuously replenished by new material being crushed.

Figure 23:
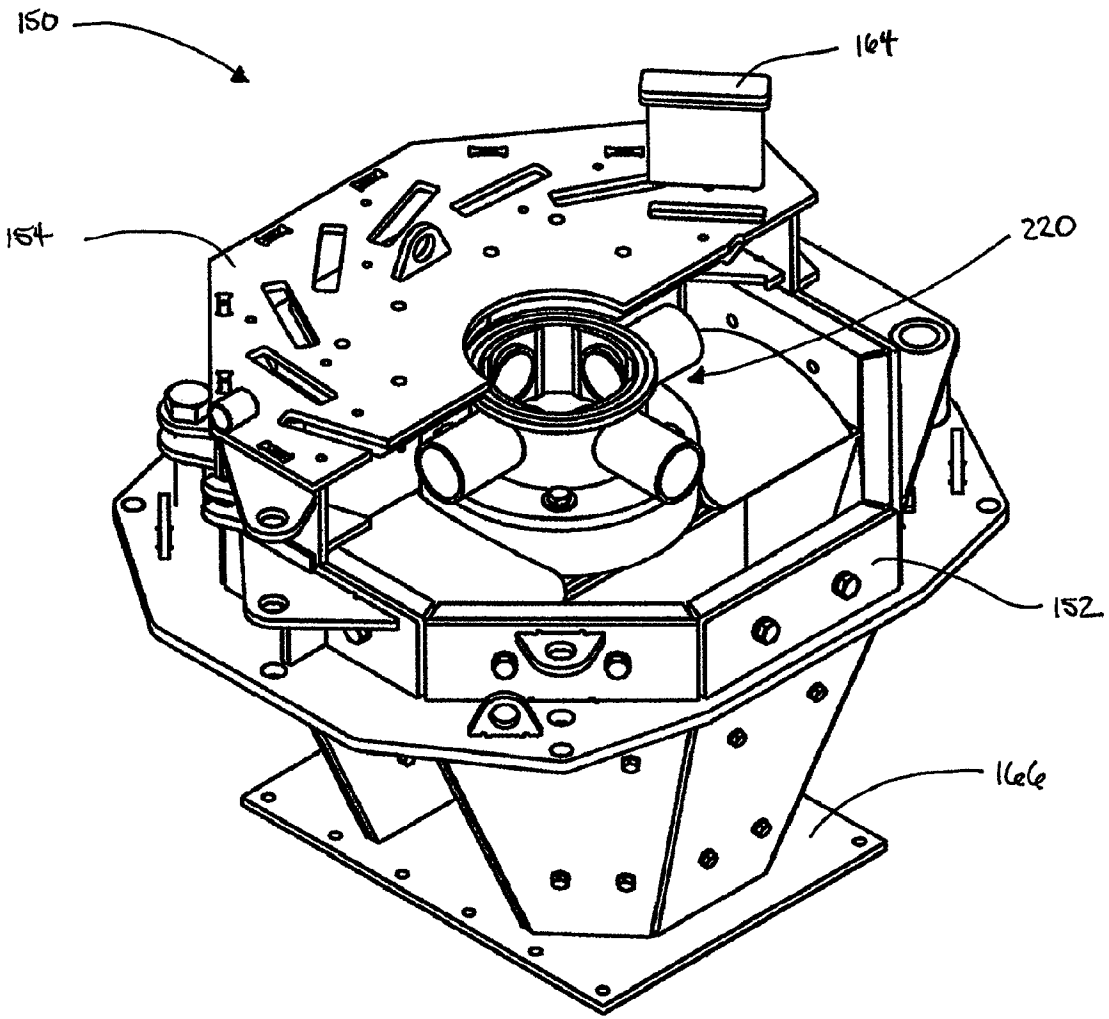
FIG. 23 is a perspective view of a tubular rotor assembly arranged in an impact crushing apparatus.
Figure 24:
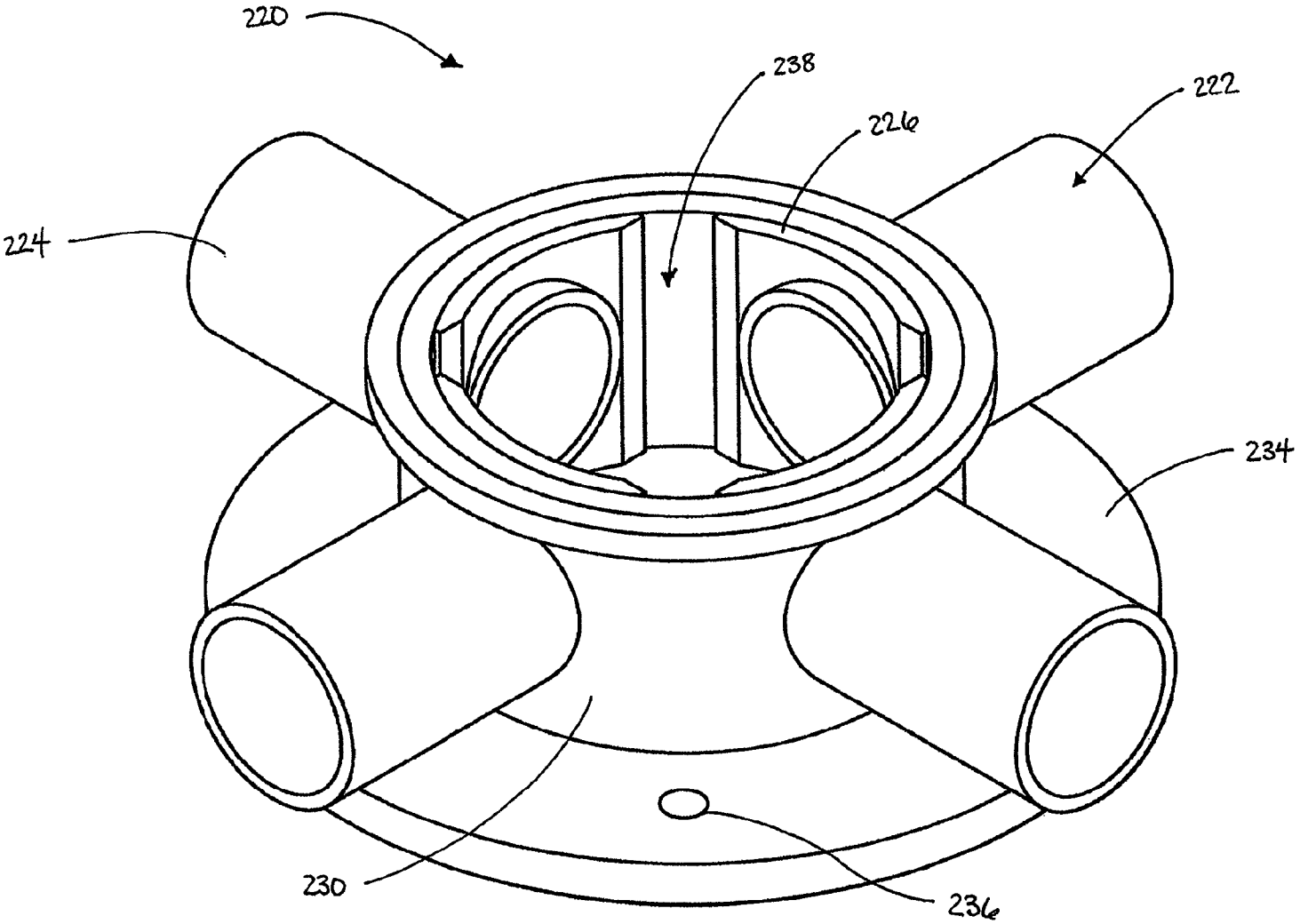
FIG. 24 is a perspective view of the tubular rotor assembly of FIG. 23 having four tubes with circular cross-sections.
Figure 25:
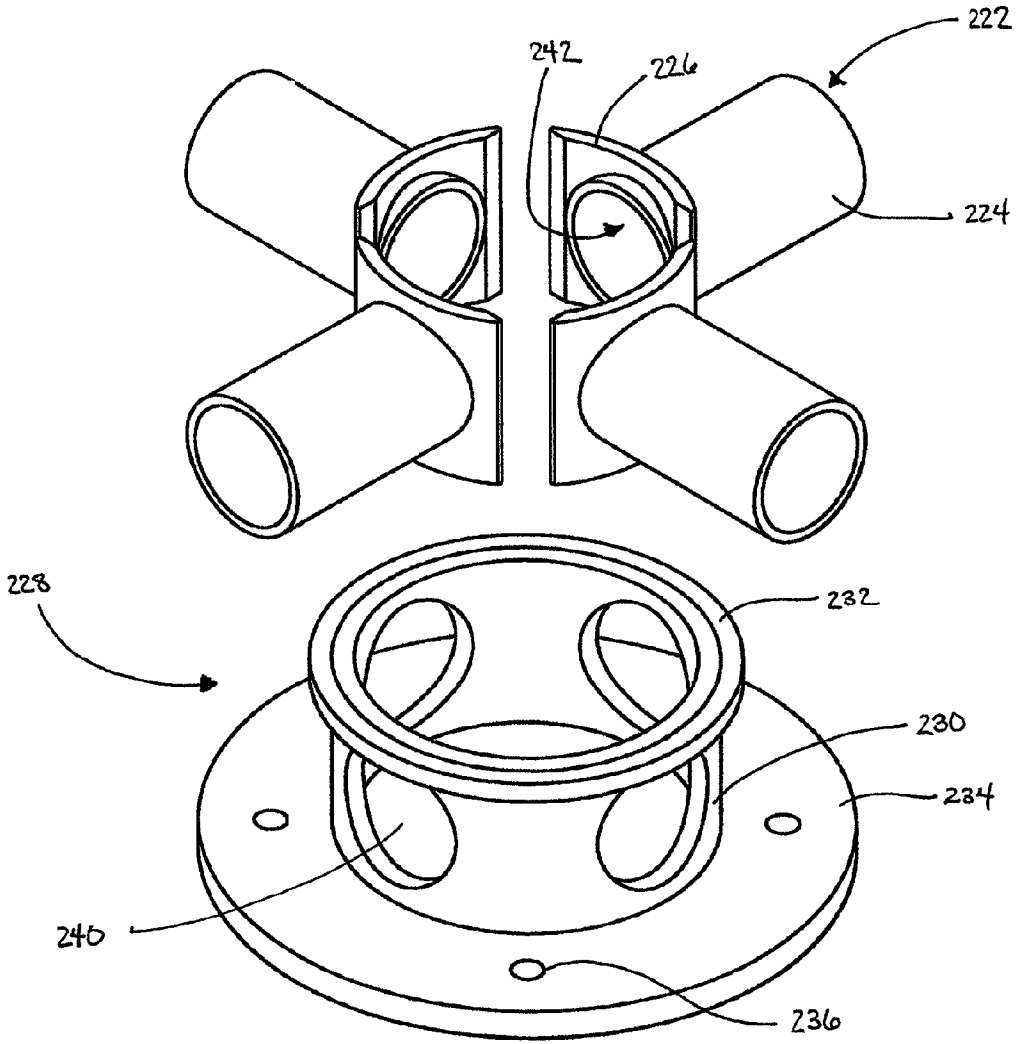
FIG. 25 is an exploded view of the tubular rotor of FIG. 24.
Figure 26:
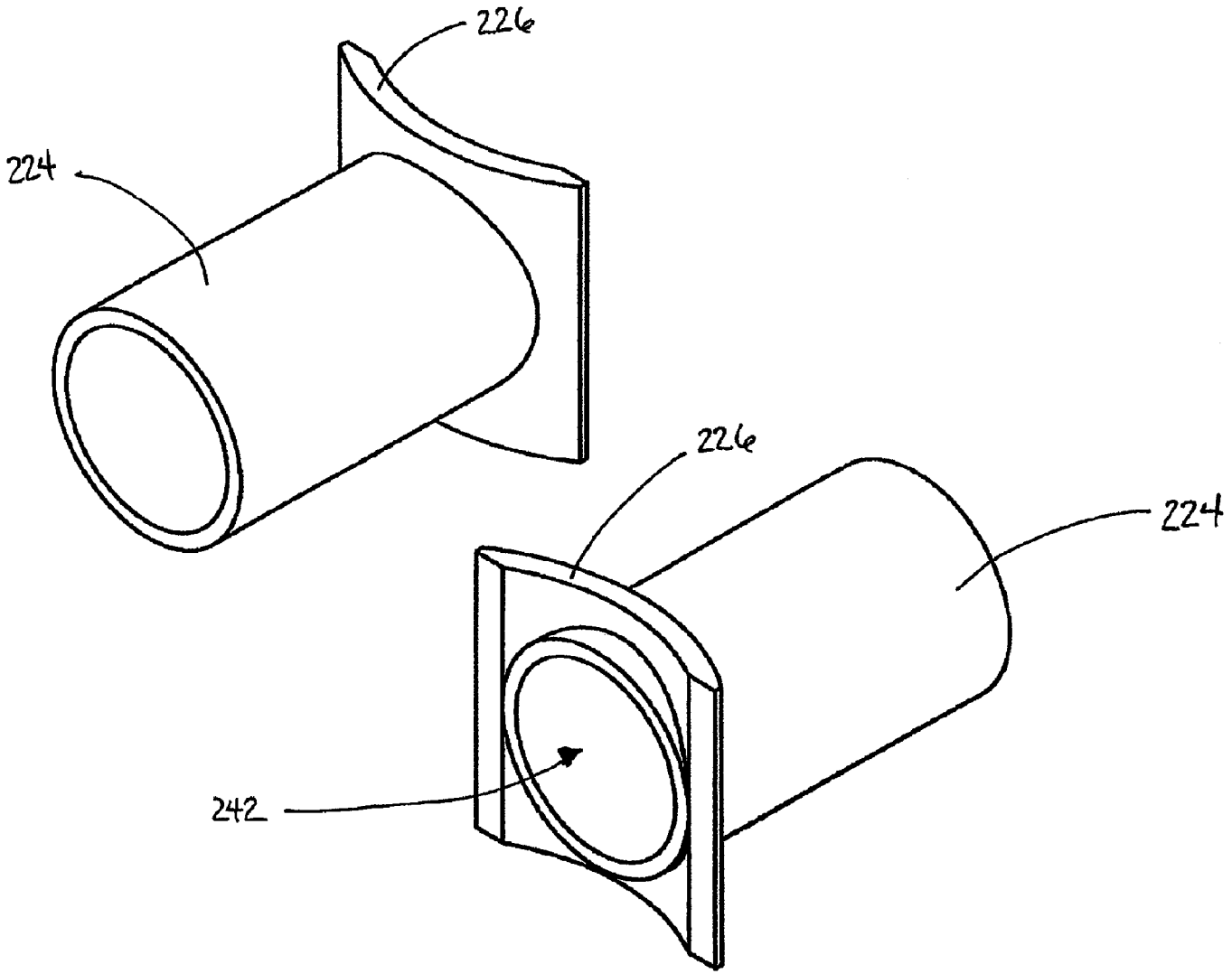
FIG. 26 is a perspective view of a tubular arm having a circular cross-section.

A different embodiment of the rotor assembly is shown in FIGS. 23-30. In FIG. 23, a tubular rotor assembly 220 is positioned in the VSI assembly 150. In this embodiment, the tubular rotor assembly 220 includes a plurality of tubes 222, a table 234, and a hoop 230 which helps form an internal opening 238. The plurality of tubes 222 replace the shoes of FIG. 17 and each tube 222 includes an arm 224 and a flange 226. As shown in FIG. 24, the flange 226 may be welded, glued, or press-fit to the arm 224. The flange 226 may also be integrally formed with the tube 224 and thus is not a separate component. The tubes 222 are hollow with a bore 242 running therethrough (see FIG. 25). Material that enters the crushing chamber passes through the internal opening 238 and is centrifugally thrown through the tubes 222.

The table 234 includes a plurality of holes 236 for coupling the tubular rotor assembly 220 to the housing or bearing cartridge of a VSI assembly. In one embodiment, these holes are countersunk holes that aid in centering the rotor assembly 220. The tubular rotor assembly 220 also comprises a rotor body 228 and ring 232. The rotor body 228 includes a plurality of openings or receptacles 240 in which the tubes 222 pass through (see FIG. 25). The diameter of the internal opening 238 is large enough to allow the tubes 222 to fit length-wise into the middle of the rotor body 228 and slide into the openings or receptacles 240. The flange 226 of the tube 222 is curved concavely such that the outer surface of the flange abuts against the internal diameter of the hoop 236. In this embodiment, no adhesion or fasteners are used to secure the tube 222 to the rotor body 228, but rather the tubes 222 float within the openings or receptacles 240. During operation, centrifugal forces applied to the tubes 222 hold the tubes 222 to the rotor body 228.

One advantage of the tubular rotor design is that the tubes can be removed and replaced individually after being subject to significant wear. No fasteners have to be loosened and/or removed before the tubes become removable. Instead, because the tubes simply float within the openings or receptacles, the tubes can slide out of the openings or receptacles and be removed. In this embodiment, the rotor assembly 220 does not have to be removed before removing the tubes.

Another advantage is that the tubes can be rotated 180° to allow an opposite internal surface of the tubes 222 to wear. In the tubular rotor assembly 220 of FIG. 24, material generally flows along one internal edge of the tubes 222 and thus the edge wears faster than the other edges. Therefore, being able to rotate the tubes 180° without replacing the entire tube provides cost-savings. In addition, for VSI assemblies that rotate both clockwise and counterclockwise, the tubular rotor assembly 220 is fully capable of operating in either direction.

One of the biggest advantages to the tubular rotor design is that the mass of each tube 222 is centered about its respective flange 226. One of the disadvantages associated with the prior art impeller shoes is that the center of mass of each shoe is not centered on the bracket. As a result, this offset acts like a small lever arm for the centrifugal force acting on the mass of each shoe and induces a bending moment on the bracket, thereby applying more stress on the bracket and even distorting the bracket under some conditions. In the tubular rotor design, however, because the mass of each tube is centered about its flange, no lever arm is created to twist the flange and thus less stress is applied to the flange.

Figure 27:
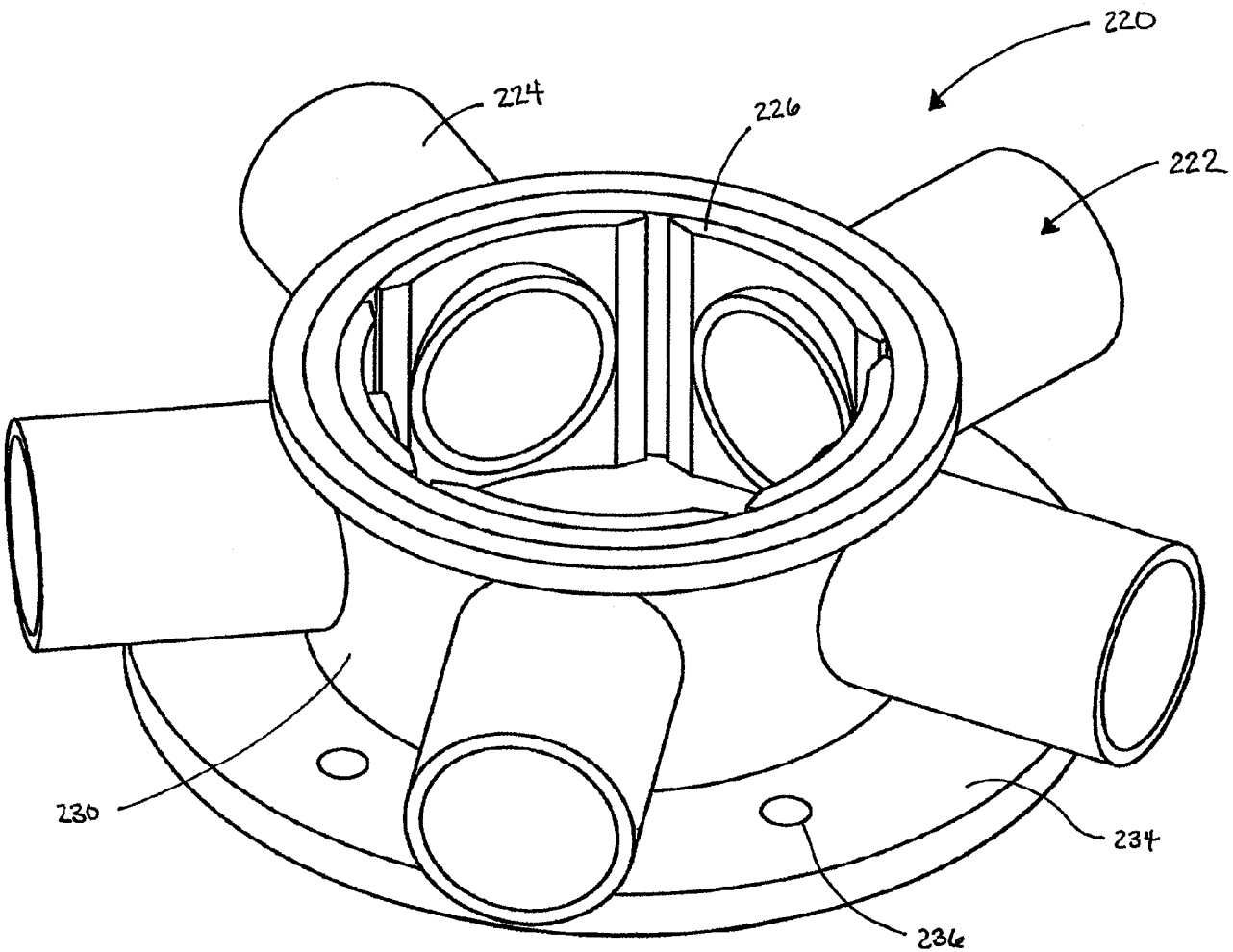
FIG. 27 is a perspective view of a tubular rotor assembly having five tubes with circular cross-sections.
Figure 28:
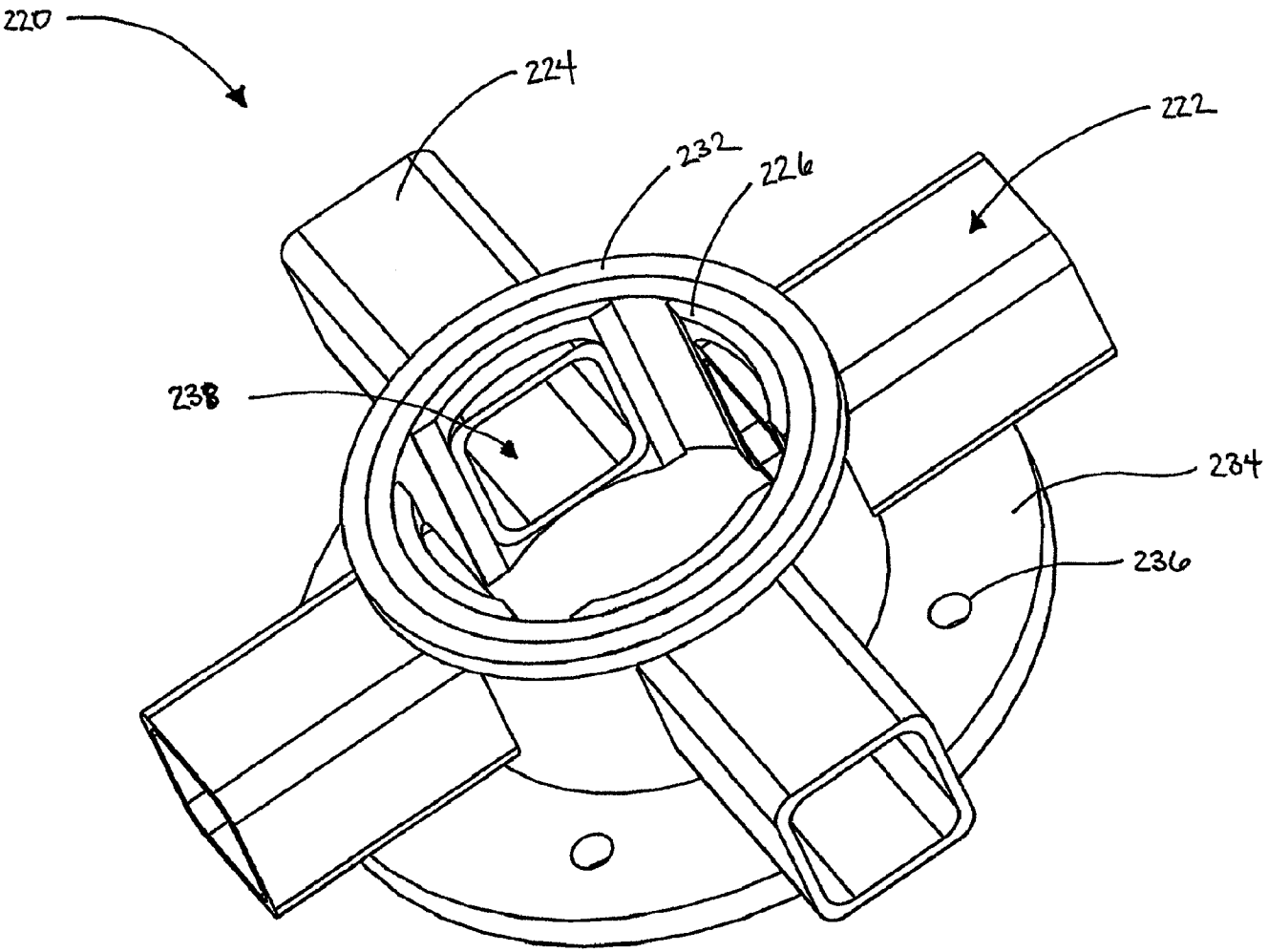
FIG. 28 is a perspective view of a tubular rotor assembly having tubes with a square cross-section.
Figure 29:
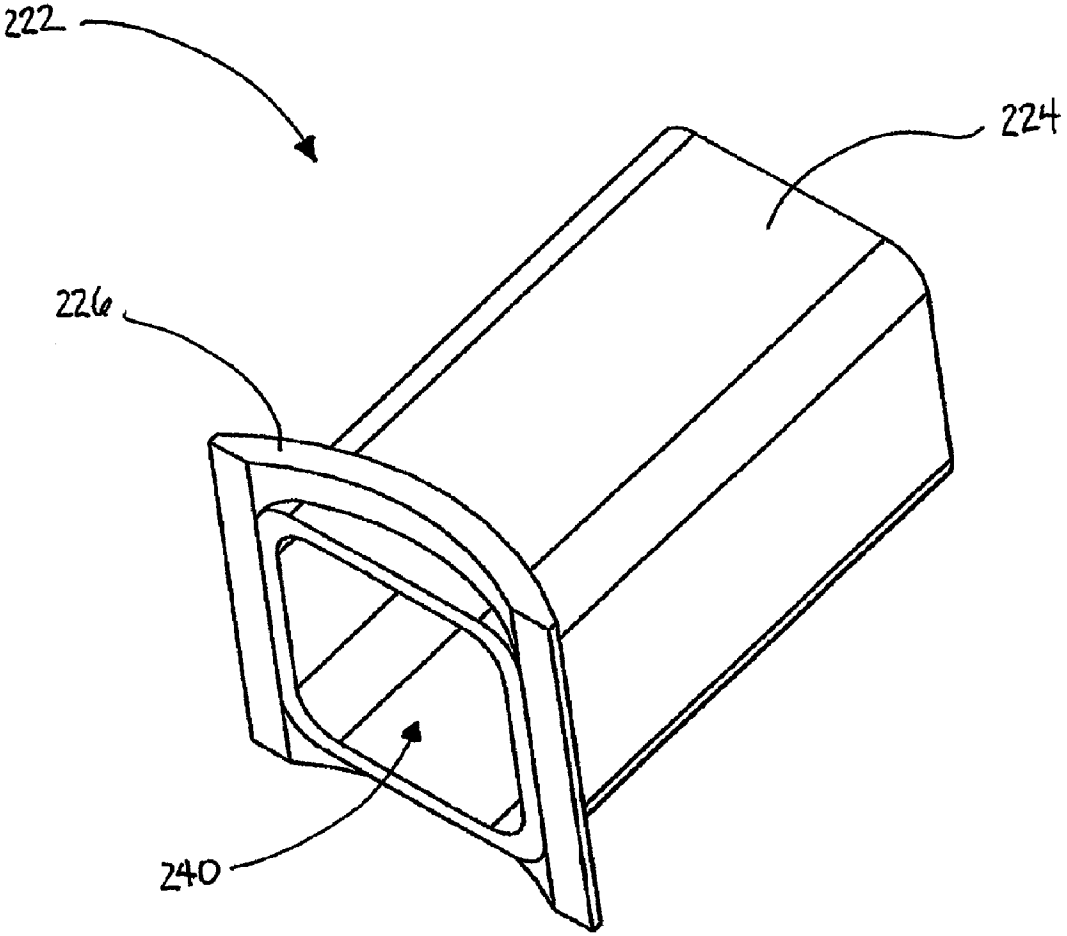
FIG. 29 is a perspective view of a tubular arm having a square cross-section.

The tubular rotor assembly 220 shown in FIG. 24 comprises four tubes 222 and each tube 222 has a circular cross-section. As shown in FIG. 27, more than four tubes 222 can be used. It may be advantageous in other embodiments to have less than four tubes 222. Also, as shown in the embodiments of FIGS. 28 and 29, the tubes 222 can have a square cross-section. In different embodiments, the tubes may have different shaped cross-sections that still provide the benefits described herein.

Figure 30:
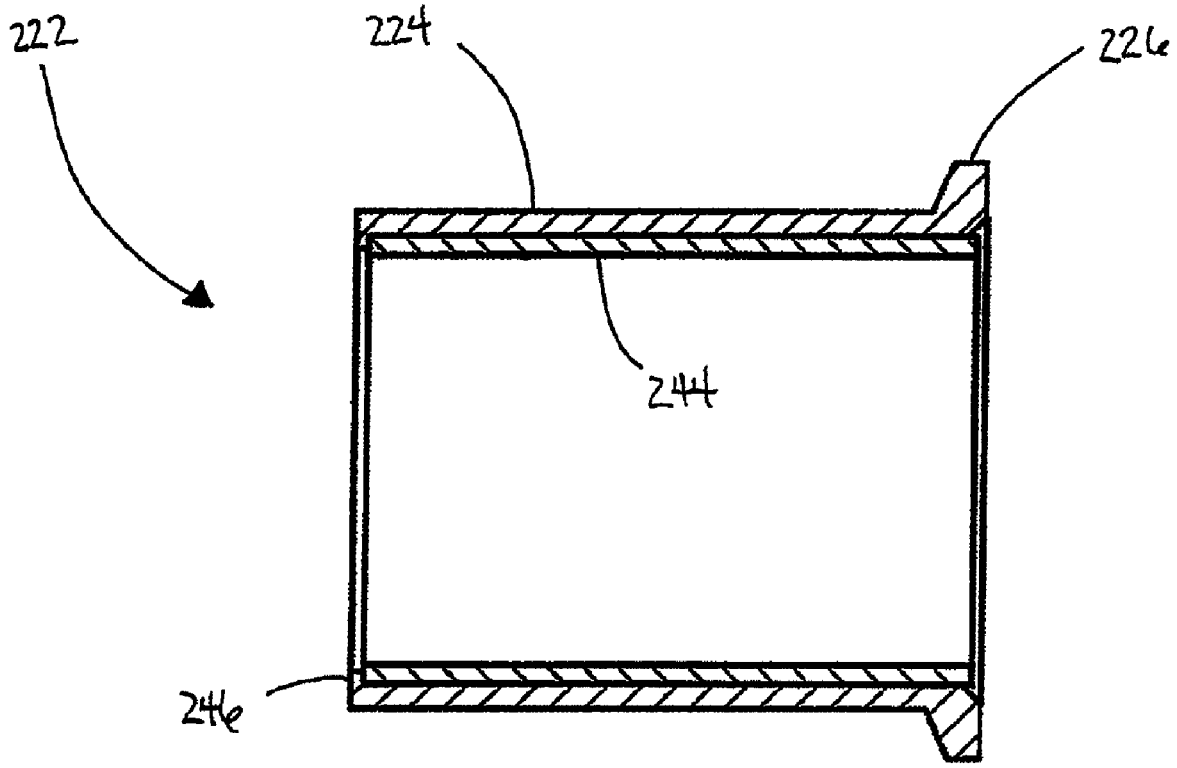
FIG. 30 is a cross-sectional view of a tubular arm having an internal sleeve.

In various embodiments, the inner and/or outer surface of the tubes 222 can be hard-coated to improve wear resistance. In addition to being hard-coated, a sleeve 244 can be installed inside the tubes 222. As shown in FIG. 30, the sleeve 244 abuts against a lip 246 of the tube 222 to secure the sleeve 244 from sliding radially outward. An adhesive can be used to further secure and adhere the sleeve 244 within the tube 222. The sleeve can be made of any ceramic, carbide or other hard material.

Figure 31:
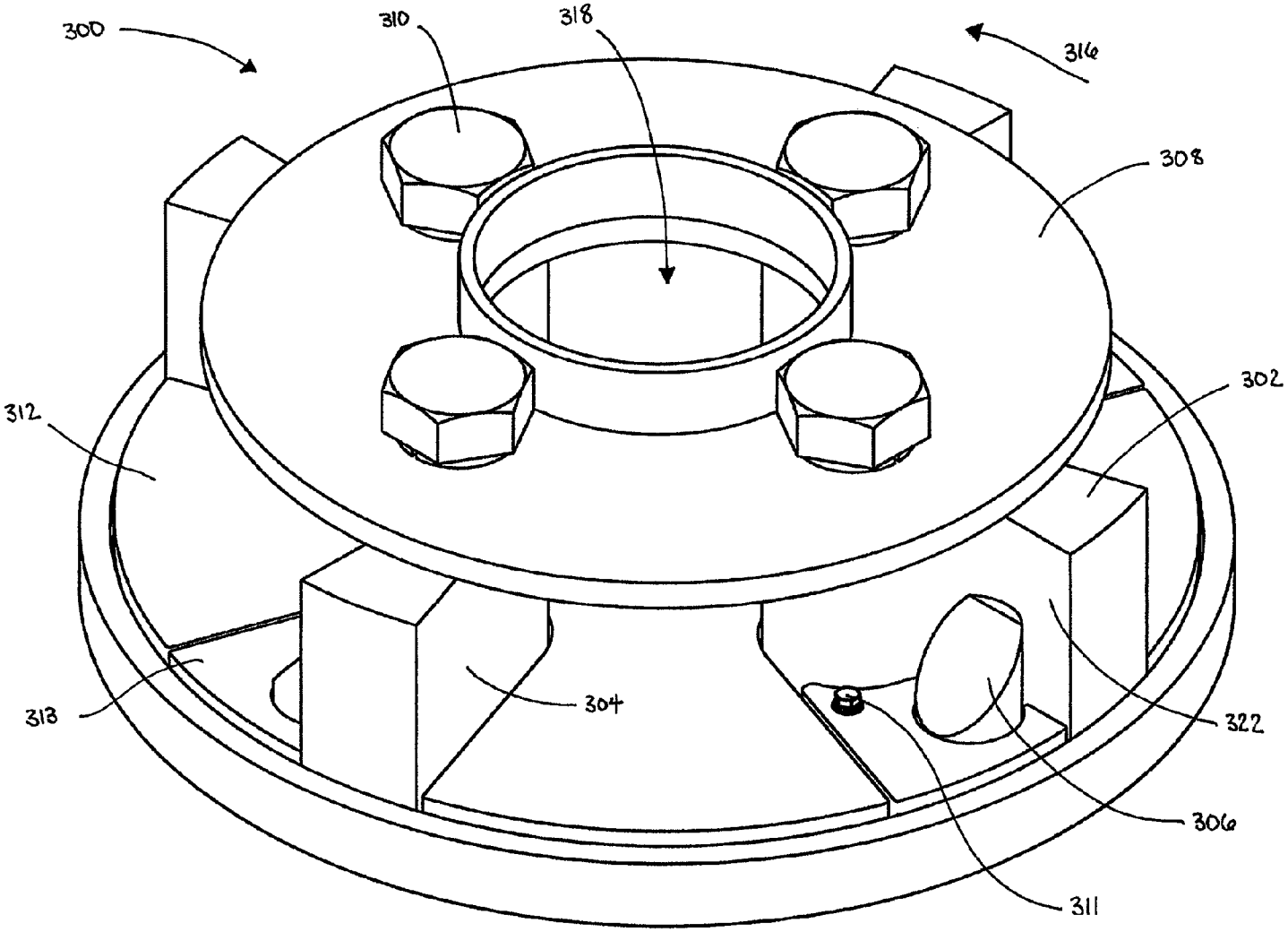
FIG. 31 is a perspective view of a rotor assembly having pivoting shoes.

A different embodiment of the rotor assembly is shown in FIG. 31. Similar to the tubular rotor assembly described above and shown in FIGS. 16, 17 and 20, material enters through an internal opening 318 of a rotor assembly 300 and the material is thrown radially outward by a plurality of shoes 302. The shoes 302 are free to pivot about a pin 310, but are prevented from pivoting 360° in either direction because of a stopper 306 that abuts against one surface 322 of the shoes 302 (see FIG. 31). The shoes 302 may be made of ceramic, tungsten carbide, and/or any hard or abrasive material.

The pivoting shoe 302 is an improved design that is not held fixed to a bracket or similar structure. In rotor designs where the shoe is held fixed to a bracket, for example, centrifugal forces act on the mass of the shoe as a result of the high rotational speeds of the rotor assembly. Generally, the mass of these shoes is not centered on the bracket, and consequently the centrifugal force creates a bending moment that induces significant stresses on the bracket, and in some instances, distorts the bracket. In the pivoting shoe design of FIG. 31, because the shoe 302 is not held fixed to the stopper 306 or pin 310, a bending moment is not asserted against either the stopper 306 or pin 310. Therefore, the combination of the pin and stopper provide additional strength and can handle higher rotational speeds.

Figure 32:
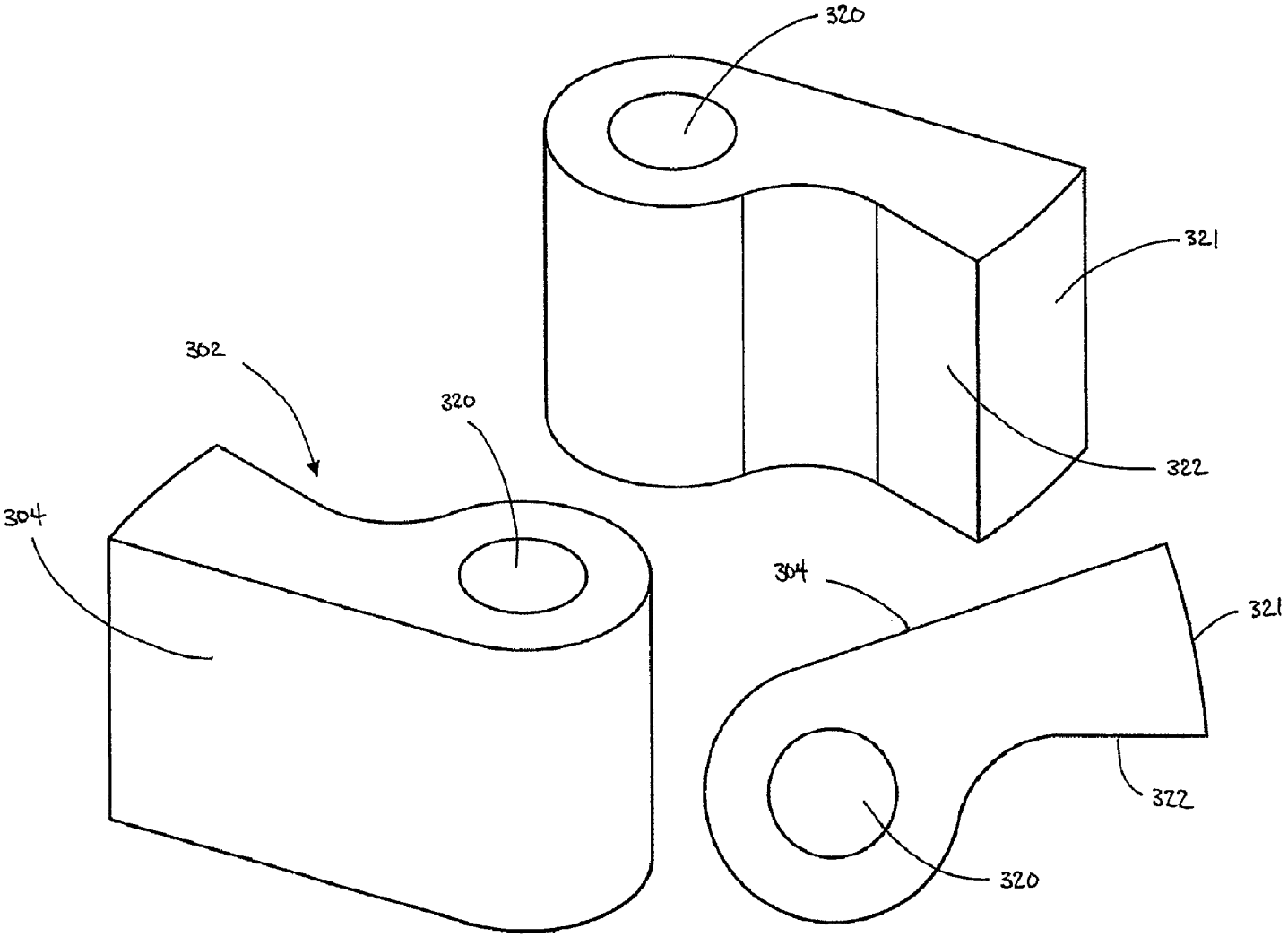
FIG. 32 is a perspective and top view of the pivoting shoe of the rotor assembly of FIG. 31.

In the embodiment shown in FIG. 31, the shoes 302 can pivot in either direction as the rotor assembly 300 rotates in a direction indicated by 316. Material that enters the internal opening 318 is brought into contact with an impact surface 304 of one of the shoes 302 and is thrown radially outward. The impact surface 304 is generally flat and planar and has a length extending from a pin hole 320 to a free edge 321 (see FIG. 32). In one embodiment, the free edge 321 can be flat and extends further away from the center of rotation than the abutting surface 322. In a different embodiment, the free edge 321 can be curved to fit the edge of the rotor. Looking down at the top surface of the shoe 302 in FIG. 32, the stopper abutment surface 322 angles inward from the free edge 321 toward the pin hole 320 before curving concavely as the perimeter of the shoe 302 encircles the pin hole 320.

Figure 33:
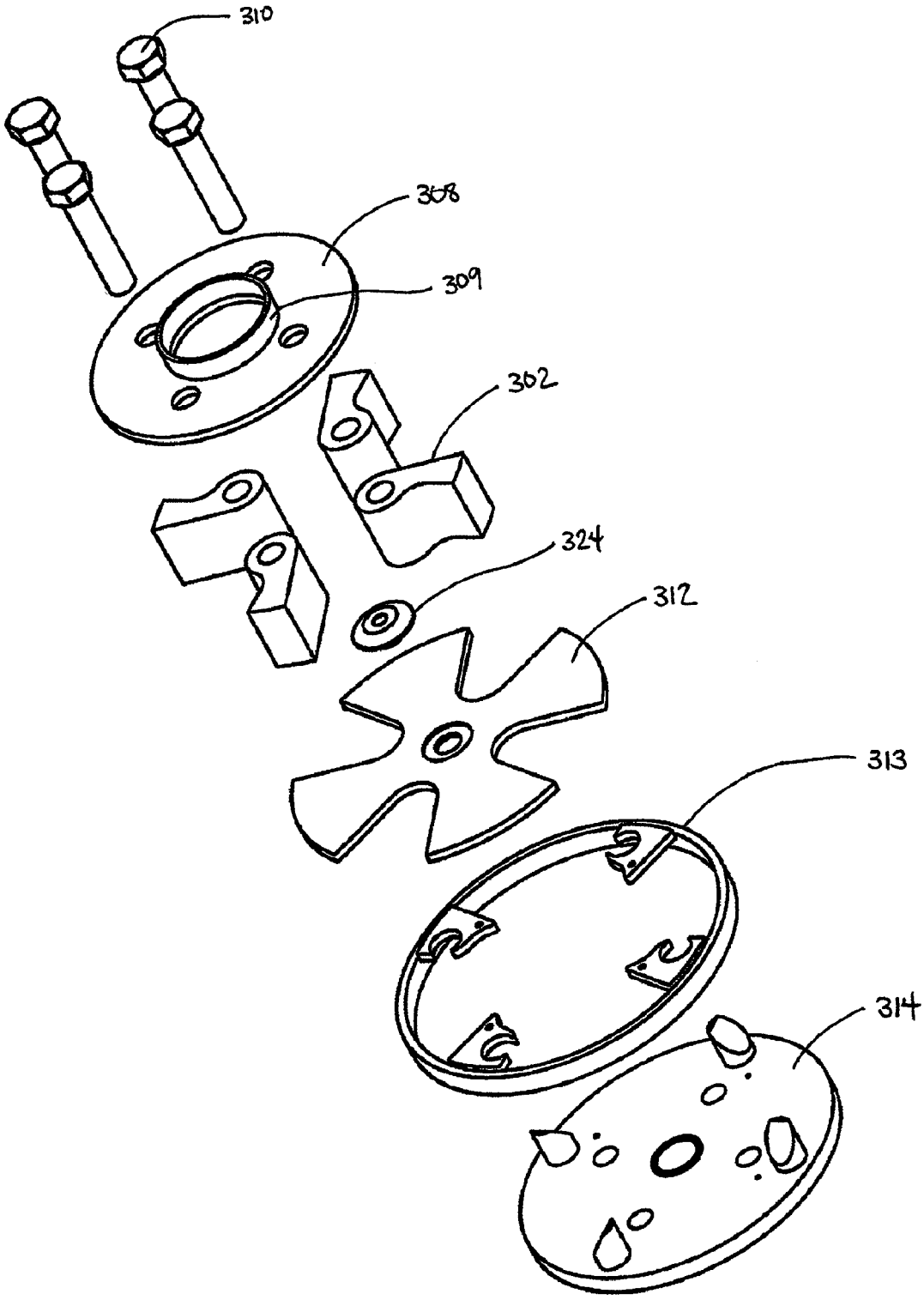
FIG. 33 is an exploded view of the rotor assembly of FIG. 31.
Figure 36:
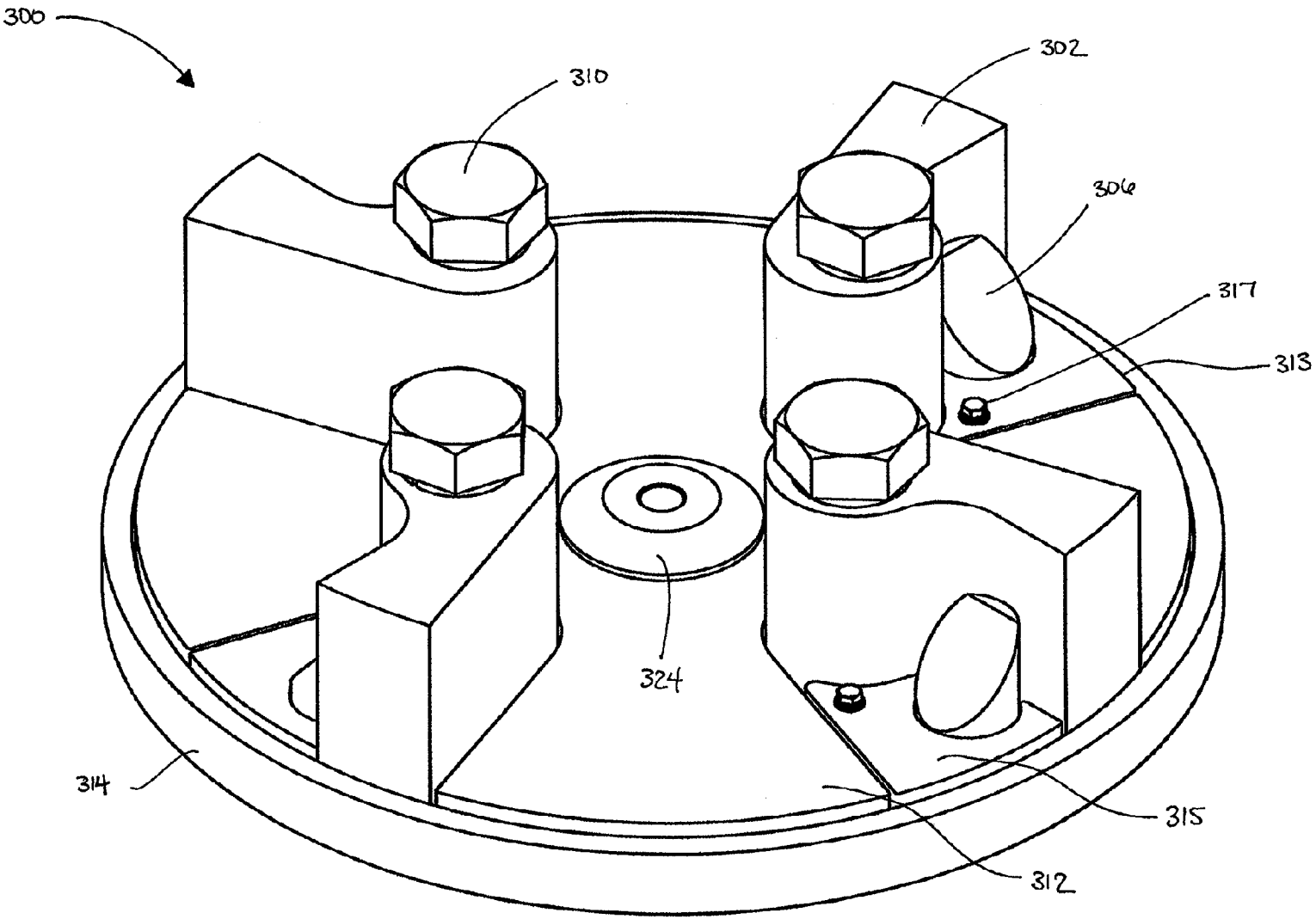
FIG. 36 is a perspective view of the rotor assembly of FIG. 31 without a pin ring.

In FIG. 31, the rotor assembly 300 includes a table 314 (not shown), a table ring 313, a liner 312, a fastener 311, a plurality of shoes 302, a ring 308, and a plurality of pins 310. In one embodiment, the liner 312 has a cross-like shape (FIG. 33) that substantially covers the area around the plurality of shoes 302 (but the shoes do not actually rest on the liner) and prevents material from getting underneath the shoes 302 and wearing out the pins 310. In other embodiments, the liner 312 may cover the top surface of the table 314 and thus the shoes 302 would rest on the liner 312. A center piece fastener 324 may be used to hold or secure the liner 312 against the table 314. This center piece 324 may also help disperse material from the center of the table 314. Additionally, the ring 308 provides support to the pins 310 during operation and includes a central opening (as shown) that permits material to enter and an adapter portion 309. However, the ring 308 is not essential to the rotor assembly 300 and may not be included in other embodiments (see FIG. 36).

Figure 35:
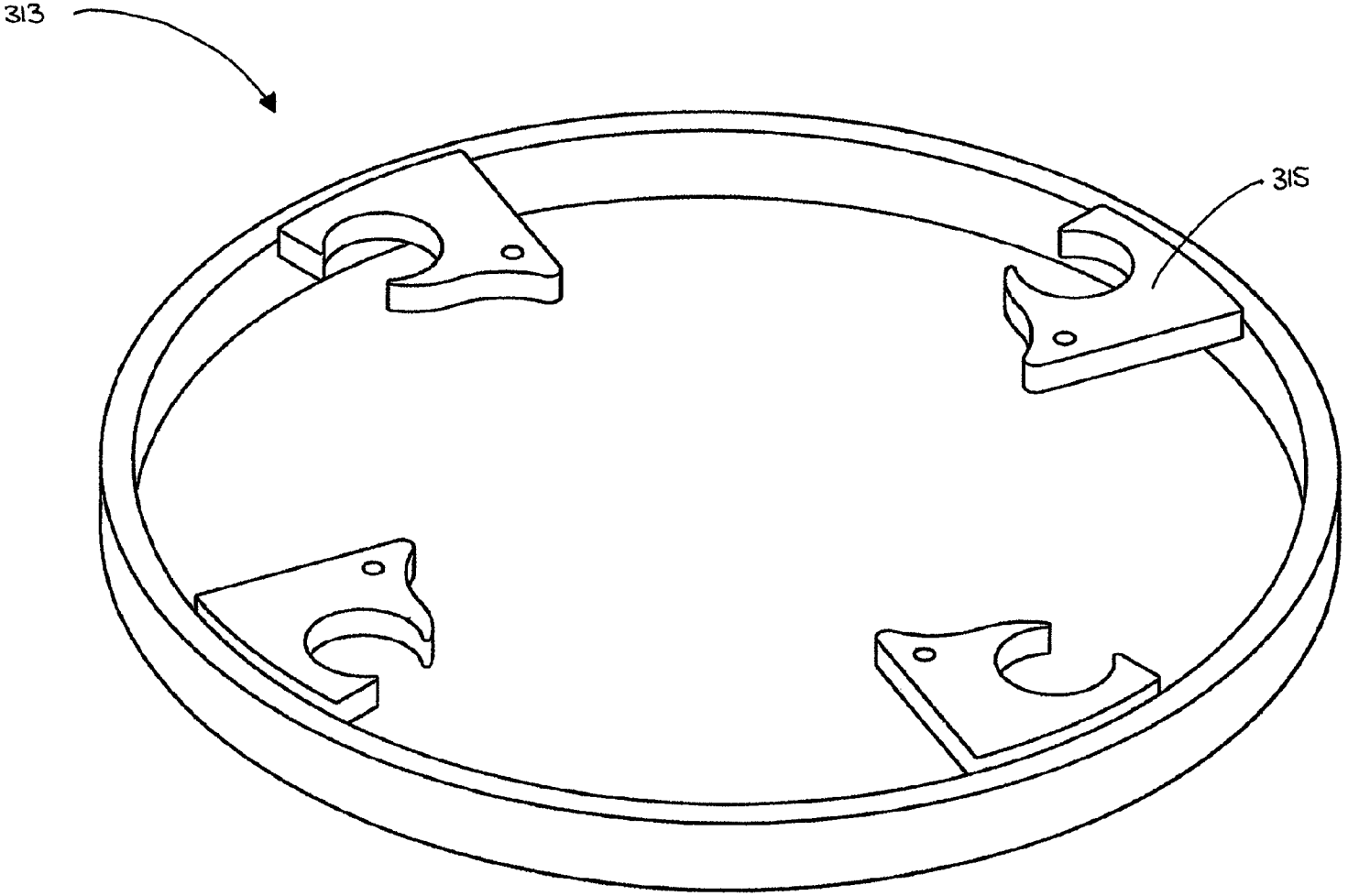
FIG. 35 is a perspective view of a table ring.

Also, an embodiment of the table ring 313 is shown in more detail in FIG. 35. The table ring 313 includes a plurality of claws 315 disposed on the inner diameter of the table ring 313. There are the same number of claws 315 as there are stoppers 306. As shown in FIG. 31, each stopper 306 may abut each claw 315, although in other embodiments the stoppers 306 do not contact the claws 315. The table ring 313 is fastened to the table 314 via screws or other fasteners 317.

The plurality of pins 310 may also be bolts or screws or any other type of fastener of any size that permits the plurality of shoes 302 to pivot. The pins 310 are inserted through pin holes 320 in the shoes 302 (see FIG. 33). The plurality of shoes 302 may be made from high crome iron, although other materials may be used to make the shoes. The ring 308 may be made from mild steel, although it too can be made from different materials.

Figure 34:
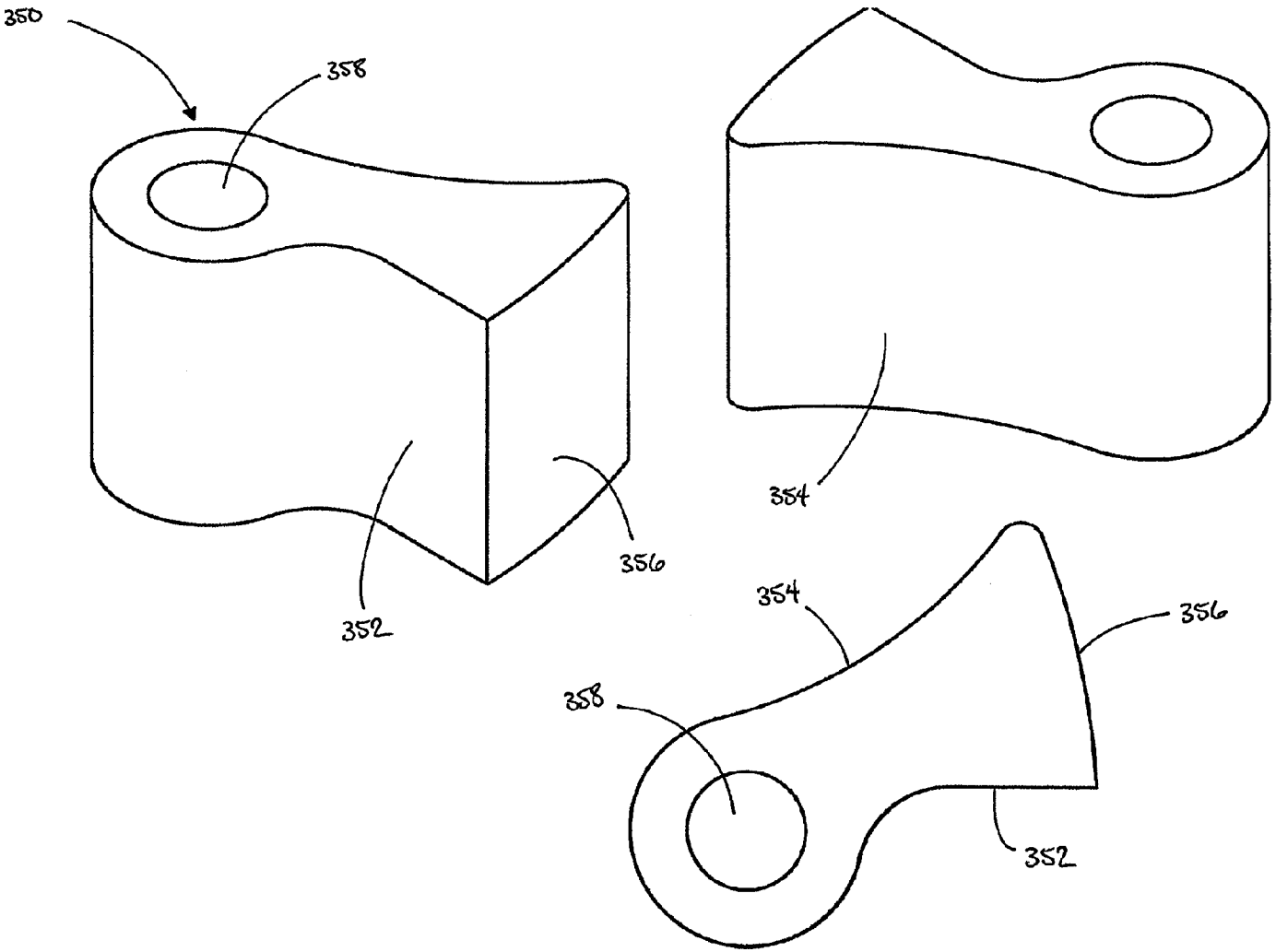
FIG. 34 is a perspective and top view of a different embodiment of a pivoting shoe.

In FIG. 34, another embodiment of a pivoting shoe 350 is illustrated. Similar to the pivoting shoe in FIG. 32, the pivoting shoe 350 includes a stopper abutment surface 352 and an impact surface 354. The impact surface 354 thrusts material radially outward as the rotor assembly is rotationally driven. The pivoting shoe 350 further includes a free edge 356 and a through hole 358 for receiving a pin or similar fastener. The free edge 356 is more curved than flat such that the free edge 356 fits the curvature of the rotor base.

While exemplary embodiments incorporating the principles of the present invention have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An impact crushing apparatus, comprising:

a housing;

a chamber defined within the housing, the chamber having a central region and an outer periphery;

a rotor assembly disposed within the central region of the chamber and configured to receive and transport material from the central region to the outer periphery of the chamber;

a lid for closing the chamber, wherein the lid defines a plurality of openings positioned about the perimeter of the lid; and a plurality of anvils slidably receivable in the plurality of openings in the lid, wherein the anvils include a top portion and a bottom portion, the top portion being supported by the lid and the bottom portion being positioned within the chamber and having an impact surface oriented toward the rotor assembly when the lid is closed.

2. The impact crushing apparatus of claim 1, wherein the plurality of anvils hang from the lid and are positioned within the chamber when the lid is closed.

3. The impact crushing apparatus of claim 1, wherein the top portion of the plurality of anvils is a flange that engages the top surface of the lid.

4. The impact crushing apparatus of claim 1, further comprising a shelf disposed within the housing, the shelf extending from an outer wall of the housing towards the central region of the chamber, wherein the provides support to the plurality of anvils.

5. The impact crushing apparatus of claim 4, wherein the shelf contacts a surface of the plurality of anvils.

6. The impact crushing, apparatus of claim 1, further comprising a plate for securing the plurality of anvils to the lid, wherein the plate includes, a plurality of stoppers disposed on the bottom surface of the plate, the plurality of stoppers contacting the lid and defining a gap between the plate and the lid.

7. The impact crushing apparatus of claim 6, wherein the plurality of stoppers are, positioned about the inner periphery and the outer periphery of the plate.

8. The impact crushing apparatus of claim 7, wherein the plate is arcuate and the plurality of stoppers are positioned about the inner and outer diameters of the plate.

9. The impact crushing apparatus of claim 1, wherein the cross-section of the plurality of openings of the lid is rectangular.

10. The impact crushing apparatus of claim 1, wherein the plurality of openings of the lid are positioned about the perimeter of the lid and angled relative to the center of the rotor assembly such that at any given moment the length of at least one of the plurality of openings is substantially perpendicular to a direction in which the rotor assembly transports material from the central region to the outer periphery of the chamber.

11. The impact crushing apparatus of claim 1, further comprising a gasket disposed between the top portion of the anvil and the lid, wherein the gasket is adapted to prevent dust or other particles from escaping within the chamber through the openings.

12. The impact crushing apparatus of claim 1, wherein the lid includes a first portion and a second portion, the first portion pivoting about a first hinge and the second portion pivoting about a second hinge between an open position and a closed position, further wherein the first portion and second portion are spread apart in the open position.

13. The vertical shaft impact apparatus of claim 12, wherein the lid comprises an octagonal cross-section.

14. The vertical shaft impact apparatus of claim 12, wherein the lid comprises a hexagonal cross-section.

15. The vertical shaft impact apparatus of claim 12, wherein the lid comprises a square cross-section.

16. The vertical shaft impact apparatus of claim 12, wherein the lid comprises a circular cross-section.

17. The vertical shaft impact apparatus of claim 12, further comprising a pin, wherein the first portion of the lid includes a first latch tongue that defines a first hole and the second portion of the lid includes a second latch tongue that defines a second hole, the pin sliding through both the first and second holes for fastening the lid closed.

18. The vertical shaft impact apparatus of claim 17, wherein the housing includes a housing tongue that defines a third hole being in vertical alignment with the first and second holes of both latch tongues, the pin sliding through the third hole in the housing tongue to lock the first portion and the second portion together with the housing.

19. The vertical shaft impact apparatus of claim 12, wherein the first portion and the second portion define a central opening configured for receiving material.

20. An anvil assembly for an impact crushing apparatus, comprising:

a lid for the impact crushing apparatus, wherein the lid defines a plurality of openings positioned about the perimeter of the lid; and a plurality of anvils slidably receivable in the plurality of openings in the lid, wherein the anvils include a top portion and a bottom portion, the top portion being supported by the lid and the bottom portion extending through the lid.

21. The anvil assembly of claim 20, wherein the top portion of the plurality of anvils is a flange that engages the top surface of the lid.

22. The anvil assembly of claim 20, further comprising plate for securing the plurality of anvils to the lid, wherein the plate includes a plurality of stoppers disposed on the bottom surface of the plate; the plurality of stoppers contacting the lid and defining a gap between the plate and the lid.

23. The impact crushing apparatus of claim 22, wherein the plate is arcuate and the plurality of, stoppers are positioned about the inner and outer diameters of the plate.

* * * * *